United States Patent [19]

Burke et al.

[11] 3,991,900

[45] Nov. 16, 1976

[54] RESERVOIR COVER AND CANALIZING MEANS

[75] Inventors: Norman R. Burke, Los Gatos; Drace W. Kutnewsky; Virgil C. Price, both of San Jose; Dennis H. Gerber, Los Gatos, all of Calif.

[73] Assignee: Burke Industries, Inc., San Jose, Calif.

[22] Filed: Oct. 1, 1975

[21] Appl. No.: 618,457

[52] U.S. Cl. ..... 220/219

[51] Int. Cl.[2] ..... B65D 87/18

[58] Field of Search ..... 220/216–227; 4/172.12, 172.13, 172.14; 61/.5, 1 R, 1 F

[56] References Cited

UNITED STATES PATENTS

| | | | |
|---|---|---|---|
| 1,734,623 | 11/1929 | Griffin | 220/218 |
| 1,909,484 | 5/1933 | Bjerregaard | 220/218 X |
| 2,461,537 | 2/1949 | Feild | 220/216 X |
| 2,531,898 | 11/1950 | Ulm | 220/219 |
| 2,970,716 | 2/1961 | McCammon | 220/218 |
| 3,079,030 | 2/1963 | Moyer | 220/218 |
| 3,313,443 | 4/1967 | Dial et al. | 220/219 |
| 3,330,118 | 7/1967 | Biais | 220/225 X |
| 3,509,585 | 5/1970 | Solomon | 4/172.12 |
| 3,592,009 | 7/1971 | Glijnis | 220/219 X |
| 3,667,641 | 6/1972 | Dial | 220/219 |
| 3,815,367 | 6/1974 | Collins et al. | 4/172.12 X |

OTHER PUBLICATIONS

Report 1842, "Development of a Hasty Fuel Storage Reservoir," U. S. Army Engineer Research and Development Lab, Ft. Belvoir, Va., 12/1965.

*Primary Examiner*—William Price
*Assistant Examiner*—Stephen Marcus
*Attorney, Agent, or Firm*—James R. Cypher

[57] ABSTRACT

A flexible sheet of fluid impervious material of sufficient area to substantially cover the sidewalls and bottom of the reservoir when substantially empty and to cover and form laterally fixed positioned and well defined inter-connected surface water canals when the reservoir is filled at various levels. The surface water canals are adapted to receive, store and channel surface water which normally falls on the reservoir as rain or snow to the edge of the reservoir. The means for forming the fixed horizontally positioned canals also function to form taut, substantially horizontal portions of the cover. The depth of the canals vary as the level of the reservoir changes. The cover is supported by displacement of water rather than by separate float means.

16 Claims, 45 Drawing Figures

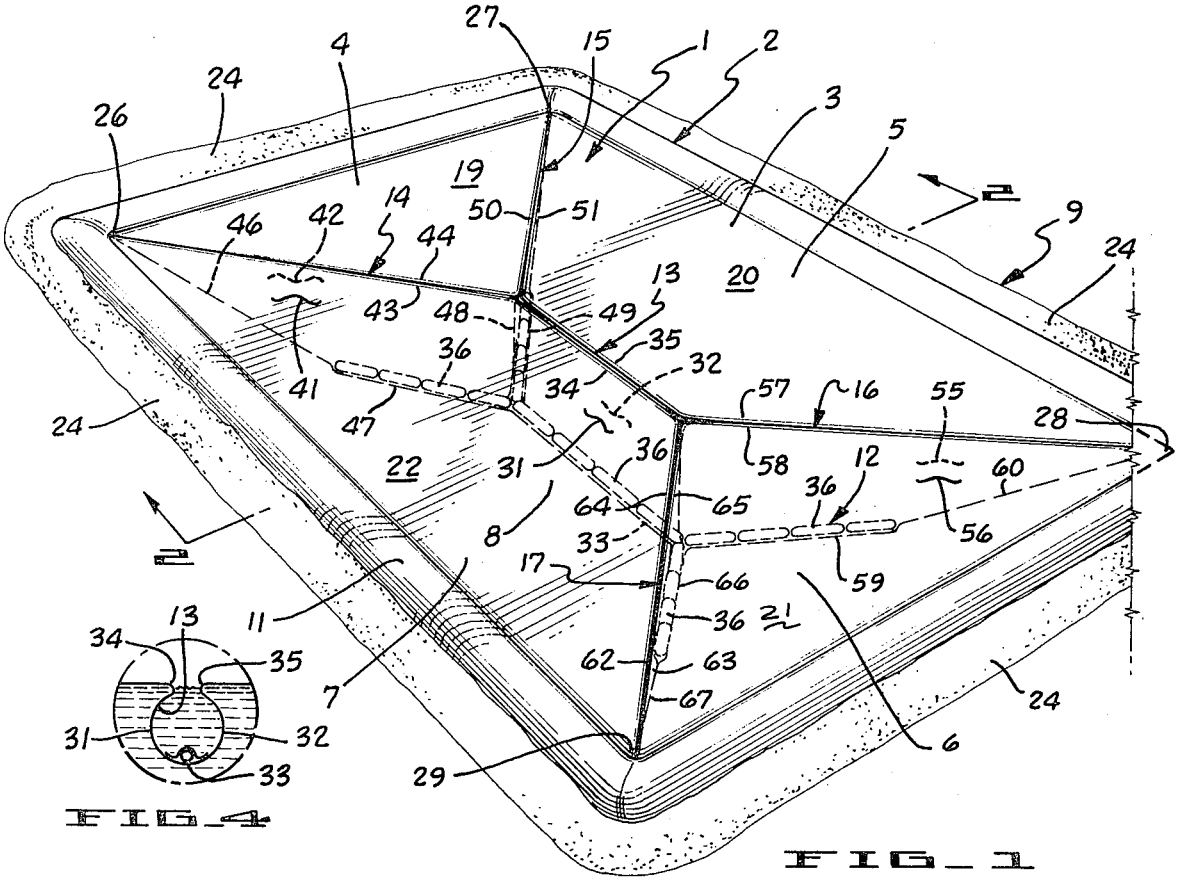
FIG_1
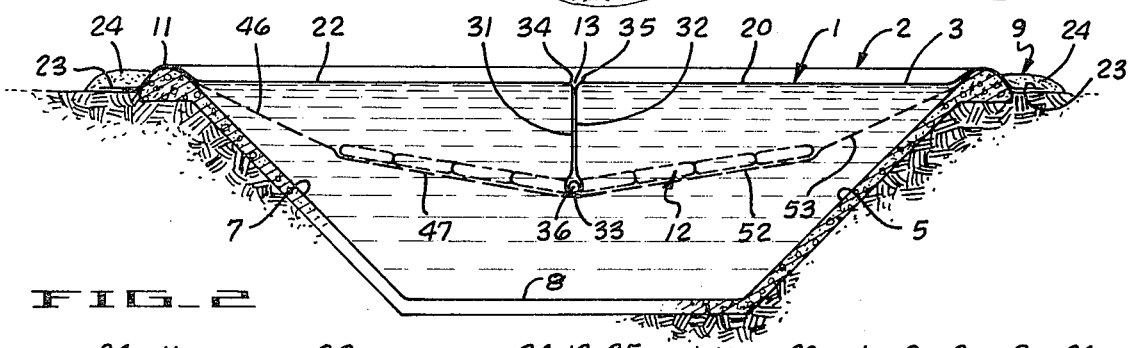
FIG_2
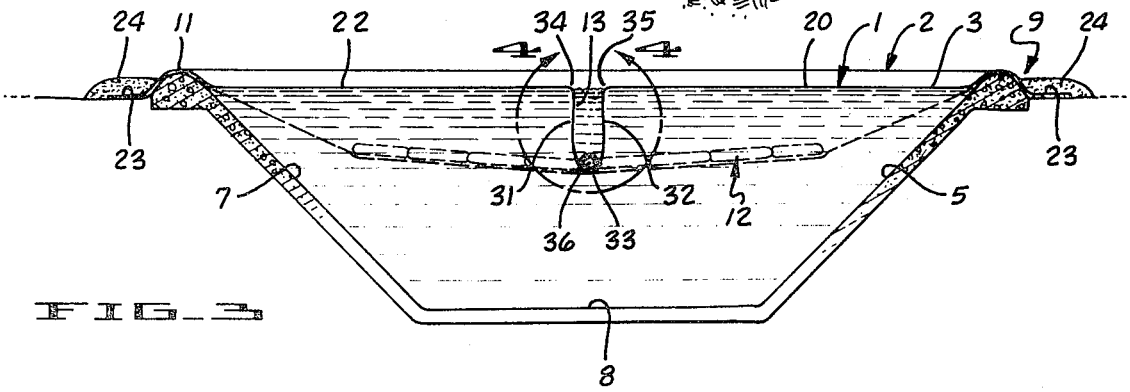
FIG_3
FIG_4

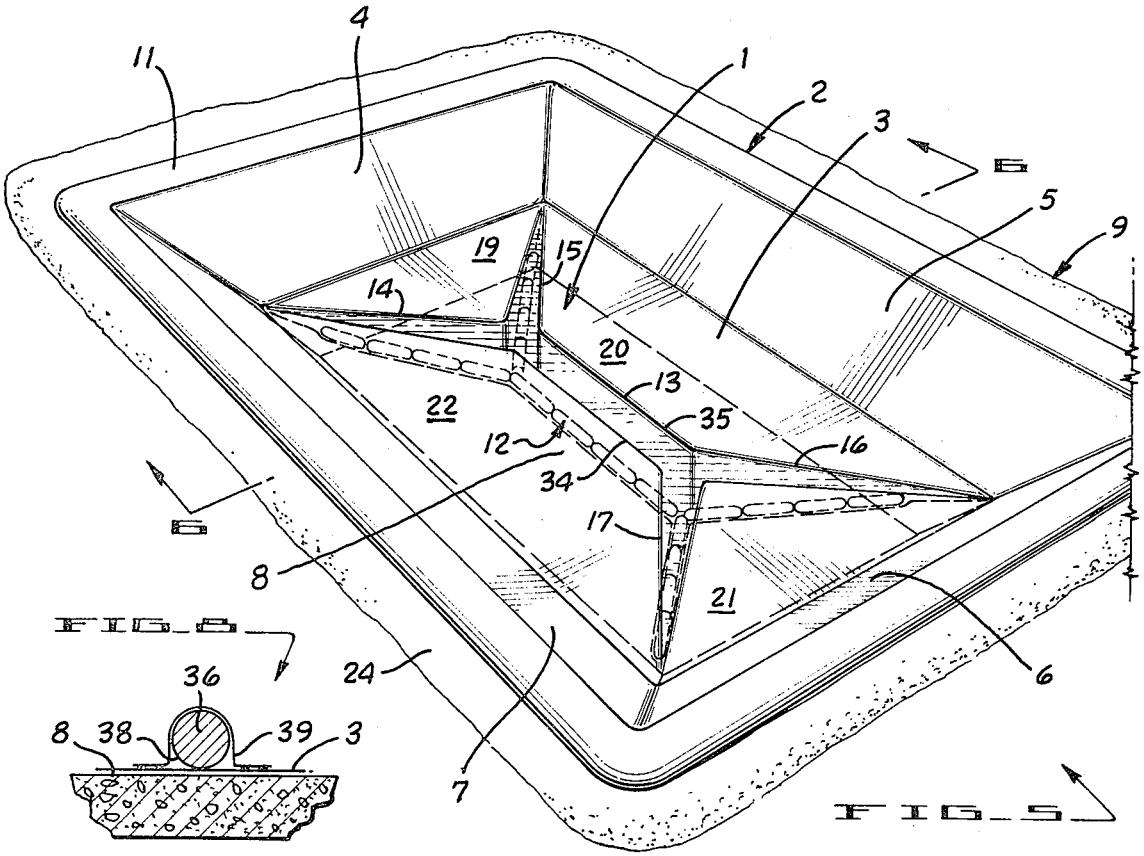
FIG_5
FIG_8
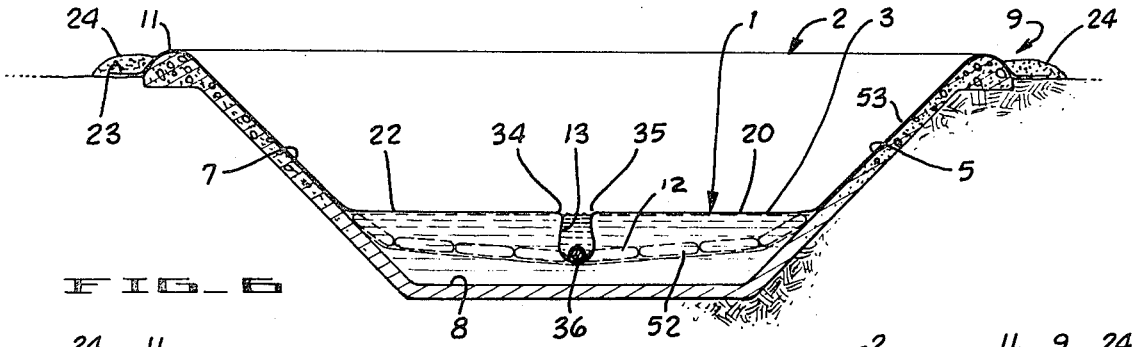
FIG_6
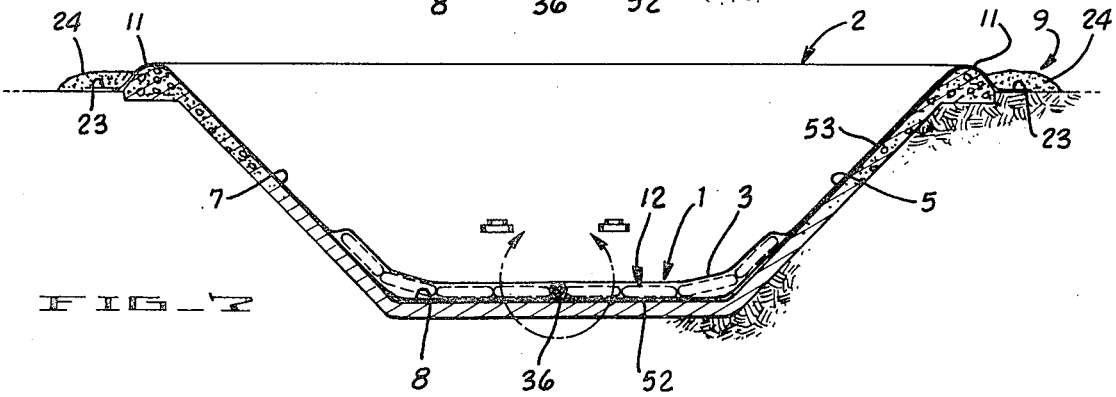
FIG_7

RESERVOIR COVER AND CANALIZING MEANS

BACKGROUND OF THE INVENTION

Potable water reservoirs must be covered to prevent contamination and loss by evaporation. Hardshell roofs are expensive and time consuming to build. Such roofs must be designed to prevent intrusion of surface water to the reservoir water. Further, in colder climes, the roof must be designed to support snow and ice loads.

An alternative to the rigid roof system for reservoirs was presented by U.S. Pat. No. 3,313,443 which taught the use of a large flexible cover supported by floats except at the border of the reservoir. Rain water was collected in border sumps which migrated horizontally as the level of the reservoir changed. The sumps were not well defined and often developed into two or more folded channels. The float system is of course expensive and must be serviced periodically. Border sumps on large reservoirs are too far from the center and such covers often are subject to large puddles which freeze in winter or cause excessive strain in the cover.

SUMMARY OF THE INVENTION

The gist of the present invention is the use of a fluid, weather resistant cover which is designed to be supported by the reservoir water or fluid itself by water or fluid displacement and is constructed with means which automatically form interconnected canals in the central part of the cover for receiving, storing and channeling surface water from horizontal areas to the edges of the reservoir.

An object of the present invention is to provide a cover for open potable water reservoirs which is substantially less expensive than hardshell reservoir roofs.

Another object is to provide a cover which does not need float means to support the cover.

Another object is to provide a cover which automatically forms well defined canals which remain in the same selected lateral areas of the sheet so that pumping equipment and debris removal equipment will not have to be shifted laterally as the level of the reservoir rises and falls.

A further object is to provide a cover construction which is particularly adapted for making an air tight seal around the perimeter of the reservoir.

Another object is to provide a cover and well defined canal system which is uniquely suited for cold climates where surface water is subject to freezing by providing a network of well defined canals throughout the surface of the reservoir to decrease surface water travel and to permit laying of steam pipes in the well defined canals to prevent formation of large chunks or sheets of ice.

Another object is to provide a cover in which the safety floats are mounted on the top surface of the cover for easy installation and maintenance.

A further object is to eliminate border sumps which make access to the cover difficult for persons who must cross the border sump to inspect or maintain the cover.

BRIEF DESCRIPTION OF THE DRAWINGS

FIG. 1 is a perspective view of the reservoir cover of the present invention installed on a sloping wall reservoir. The reservoir is full and there is no surface water.

FIG. 6 is a cross section of the reservoir shown in FIG. 5 taken along line 6—6 of FIG. 5 but with a decreased amount of water in the reservoir and with a considerable amount of surface water.

FIG. 7 is a cross section of the reservoir shown in FIG. 5 taken along line 6—6 showing the configuration taken by the cover when there is no water in the reservoir.

FIG. 8 is a cross section of the weight and portion of the cover as taken along line 8—8 of FIG. 7. The view is greatly enlarged.

FIG. 42 is a top plan view of the float system of FIGS. 30 and 31 but used in a circular and slant wall reservoir.

FIG. 43 is a cross sectional view of the reservoir shown in FIG. 42 and taken along line 43 — 43.

FIG. 44 is a top plan view of a circular vertical wall reservoir using the float system of FIGS. 30 and 31. The reservoir is shown in the empty condition.

FIG. 45 is a side view of the reservoir shown in FIG. 44 taken along line 45 — 45.

DESCRIPTION OF THE PREFERRED EMBODIMENTS OF THE INVENTION

Figure 9:
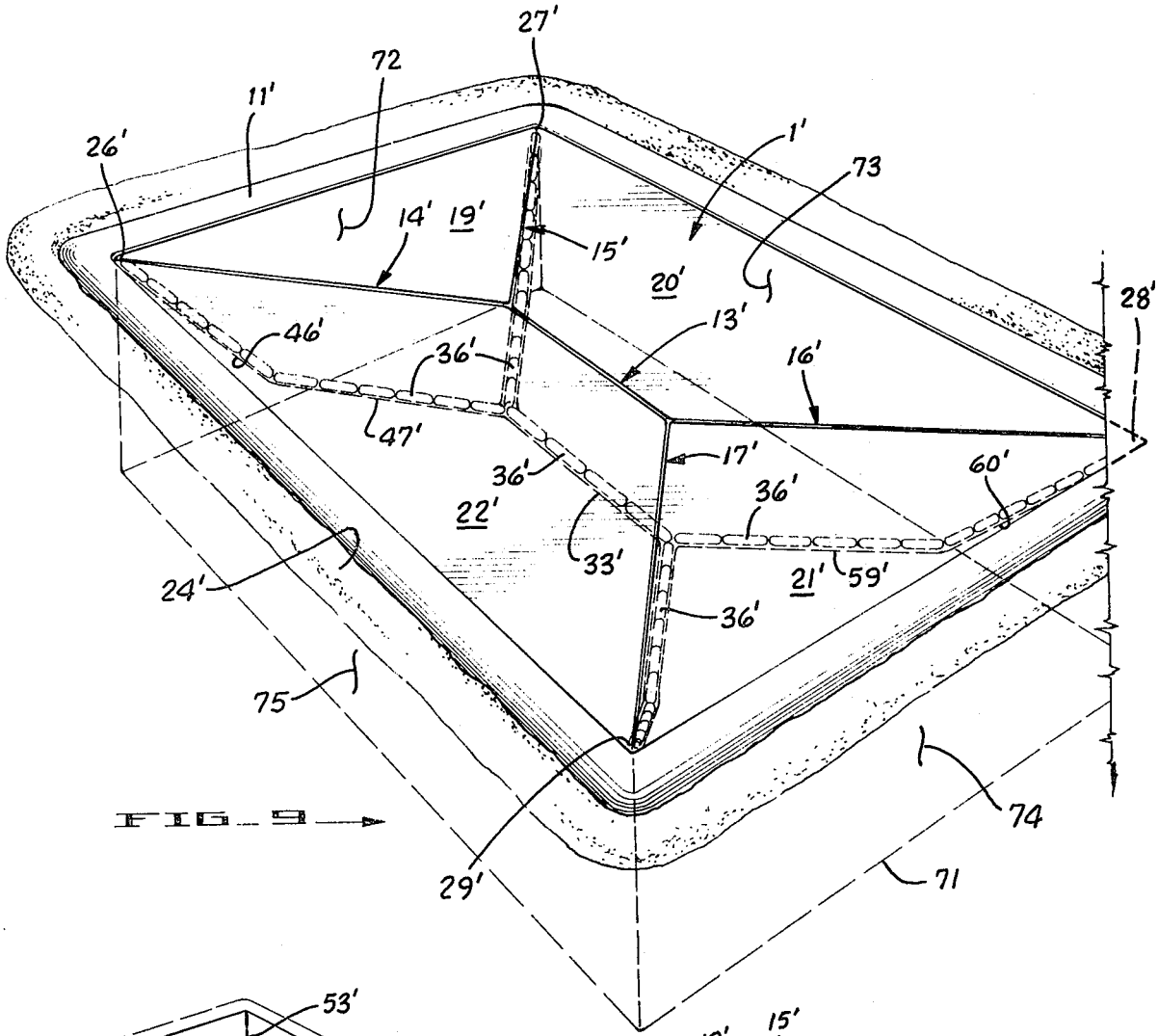
FIG. 9 is a perspective view of a vertical sided reservoir showing a modified version of the cover shown in FIGS. 1 – 8. The cover is shown in the configuration taken when the reservoir is full.

Referring to FIGS. 1 – 7 of the drawings, the cover 1 for an open reservoir 2 subject to water or fluid level change consists briefly of a flexible sheet 3 of fluid impervious material of sufficient area to substantially cover the sidewalls 4, 5, 6 and 7 and bottom 8 of the reservoir when the reservoir is substantially empty; connection means 9 connecting the cover to the upper periphery 11 of the reservoir; and canalizing means 12 create a plurality of folds in the flexible cover at preselected fixed horizontal positions and form well defined narrow and vertically elongated surface water canals 13, 14, 15, 16 and 17 over the entire range of water level conditions and form the sheet in defined generally taut substantially horizontal surface portions 19, 20, 21, and 22 supported by the displacement of water in the reservoir. Minor wrinkling in the horizontal surface portions sometimes occurs with only minor collection of water.

The canals intersect or closely approach the edge of the reservoir and are dimensioned to receive, store and channel surface water separate and apart from the water below the cover in sufficient quantity to prevent substantial build up of surface water on the horizontal surface portions. The canalizing means is constructed to interconnect all of the canals and to maintain the connections during normal raising and lowering of the cover surface.

The flexible sheet material for forming the cover is preferably made from a synthetic rubber such as Hypalon; a registered trademark of the Du Pont Company. This material has well established weather resistant characteristics and is air and fluid impervious. Other materials of comparable characteristics could be used.

In most domestic water reservoirs where the reservoir may vary from completely empty as in FIG. 7 to completely full as shown in FIG. 1, the cover must be large enough to permit it to rest upon the sides and bottom surface to prevent stresses which would damage the cover.

Any suitable means of connecting the cover to the periphery of the reservoir may be used. One of the simplest means is shown in the drawings and consists of lapping the cover over the perimeter 11 of the reservoir and holding the cover perimeter 23 by means of a layer of sand or earth 24. Preferably the perimeter of the reservoir is rounded to prevent tearing of the cover. The connection formed in this way is air and water impervious.

The periphery of the cover may also be bolted to a frame surrounding the reservoir. The periphery of the cover may be fluid and air tight or it may be vented.

The canalizing means in FIGS. 1 – 7 consists of attaching weights to either the top or bottom side of the cover along generally straight lines so that generally straight canals will be formed which intersect each corner of the reservoir and are interconnected. As shown in the drawings, the canals form generally vertical planes and remain in these same fixed planes during raising and lowering of the level of the water in the reservoir. As best seen in FIG. 1, canal 13 is formed along the longitudinal axis of the reservoir and intersects canal 14 which intersects reservoir corner 26. Canal 15 intersects canal 13 and reservoir corner 27. Canal 16 intersects reservoir corner 28 indicated by an arrow of the same number. Canal 17 intersects canal 13 and reservoir corner 29. Each canal is formed by a fold in the cover. The fold panels are vertical when there is no surface water filling the canal. Canal 13 is formed by panels 31 and 32 which are joined at the bottom by fold line 33. Fold line 33 is generally a straight line. The top edges of the canal 13 are defined by varying fold line 34 and 35. Again, the fold lines 34 and 35 are generally straight lines.

The canalizing means for forming the canals shown in FIGS. 1–7 consists of weights which are attached to the cover along those certain lines which form the bottoms of the generally vertically planar canals. To form canal 13, the weights are connected along fold line 33. The weights may be either segmented rigid or bendable members such as members 36 or elongated weighted members which bend throughout their length. A suitable type of weight is to contain sand in a segmented tube 38 and then attached the tube of sand to the cover by means of a short strip of material 39 as shown in FIG. 8. It is important that the weights have no sharp edges which could tear the material and by using either short segments or entirely flexible weights, no sharp corners are created which could tear the cover. Segmented sand filled weights do not set up tear stresses when the weight settles on the intersection of the sloping side walls and the bottom of the reservoir when the reservoir level is lowered. If for an example a long rigid or semi-rigid pipe was used as the weight, stresses would occur at the ends of the pipe which could result in tearing of the relatively thin material. Flexible plastic tubes filled with salt brine or other fluid having a specific gravity greater than fresh water could serve as the weight. The weight system also could be a perforated rubber suction hose having a higher specific gravity than water.

Canal 14 is formed by generally vertical panels 41 and 42 which are defined at their upper edges by variable fold lines 43 and 44 and at the bottom by lines 46 and 47. Note that line 46 follows the generally sloping contour of the sides of the reservoir when the water level is low while line 47 is a generally horizontal line following the flat bottom 8 when the reservoir is nearly empty.

Canal 15 is formed by generally vertical panels 48 and 49 which are defined at their upper edges by variable fold line 50 and 51 and at the bottom by lines 52 and 53. Line 53 follows the generally sloping contour of the intersection of sides 19 and 20 of the reservoir, when the level of the reservoir is low while line 52 generally follows the contour of the level bottom 8. As the water rises and falls, the slope of lines 52 and 53 and their respective lengths change.

Canal 16 is formed by generally vertical panels 55 and 56 which are defined at their upper edges by variable fold lines 57 and 58 and at the bottom by lines 59 and 60. Line 60 at low water level generally follows the sloping contour of the intersection of sides 5 and 6 of the reservoir while line 59 generally follows the horizontal bottom 8.

Canal 17 is formed by generally vertical panels 62 and 63 which are defined at their upper edges by variable fold lines 64 and 65 and at the bottom by lines 66 and 67. Line 67 at low water level generally follows the sloping contour of the intersection of sides 6 and 7 of the reservoir while line 66 generally follows the horizontal bottom 8 of the reservoir.

Figure 4:
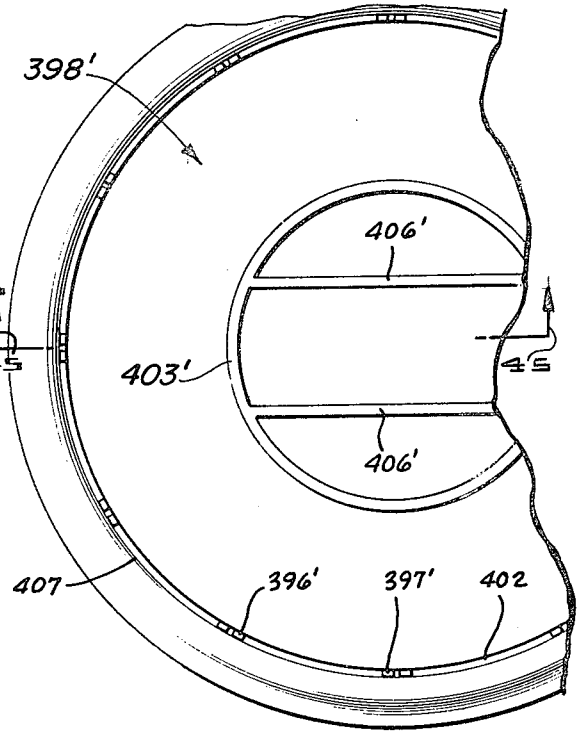
FIG. 4 is a cross section of the cover taken in the general area of line 4—4 of FIG. 3. The views shows the configuration taken by the cover with an increased amount of surface water as compared to the illustration of FIG. 3.
Figures 2, 4:
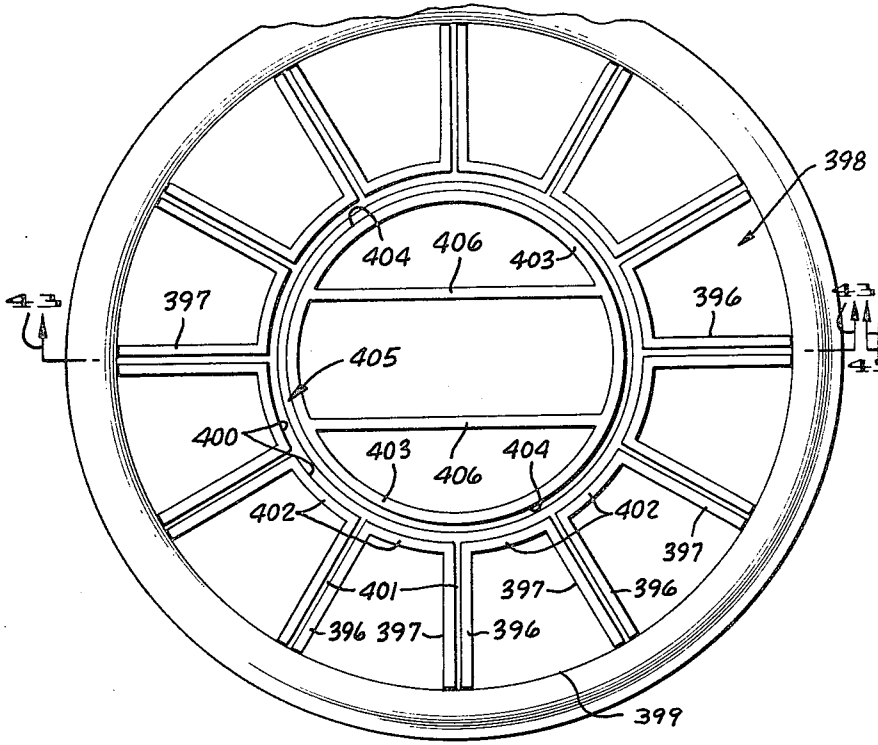
FIG. 2 is a cross sectional view of the reservoir and cover taken along line 2—2 of FIG. 1.

When the reservoir is full and their is little or no surface water, the side panels of the canals such as panels 31 and 32 tend to be in generally vertical planes and pressed tightly together by the water in the reservoir. As surface water from the horizontal portions of the reservoir builds up it tends to migrate to the canals and open them up as shown in FIG. 3. The accumulation of an even greater amount of water opens up the canals as shown in FIG. 4.

Figures 4, 5:
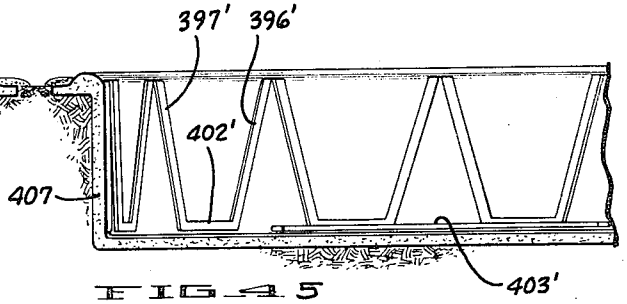
FIG. 5 is a perspective view of the reservoir shown in FIG. 1 showing the configuration of the cover shown in FIG. 1 but with the reservoir approximately half filled with water. The drawing shows the configuration taken by the cover with a considerable amount of surface water.
Figures 3, 4:
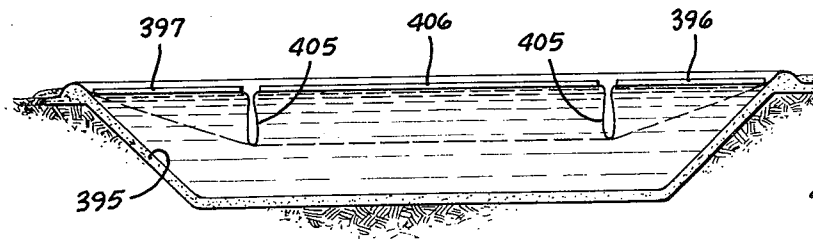
FIG. 3 is a cross sectional view of the reservoir shown in FIG. 1 taken along line 2—2 but showing the position of the cover when there is a quantity of surface water.

When the reservoir is partially empty as shown in FIG. 5, the cover follows the sloping contours of the sides 4, 5, 6, and 7 forming reduced horizontal surfaces 19, 20, 21 and 22. FIG. 5 illustrates the configuration of the canals when they are filled with surface water.

When the reservoir is completely empty, the cover generally follows the configuration of the bottom and sides of the reservoir and the weights lie on the bottom and sides of the reservoir. As may be seen the weights bend with the contour of the bottom of the reservoir. When there is no water in the reservoir there are no canals; and if the cover is properly sized there is no excess material nor is there any suspension of the cover above the bottom.

Figure 11:
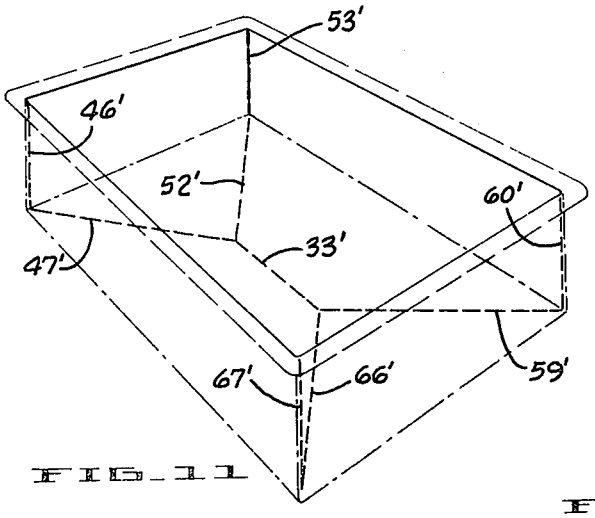
FIG. 11 is still another perspective view of the reservoir shown in FIG. 9 showing the position of the cover when the reservoir is empty.
Figure 10:
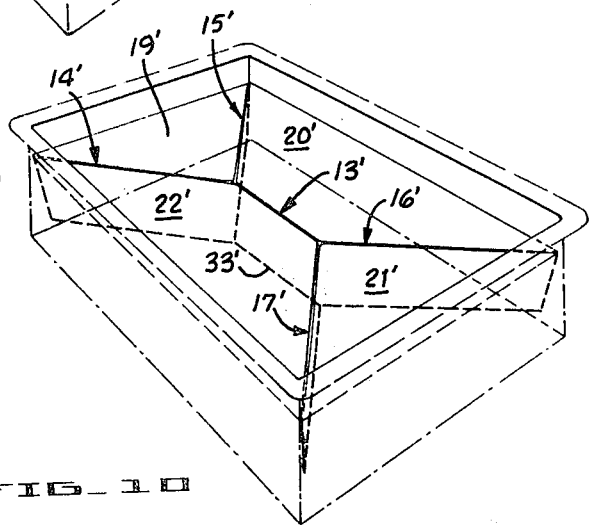
FIG. 10 is a perspective view of the reservoir shown in FIG. 9. The cover is shown in the configuration taken when there is less water in the reservoir than in FIG. 9.

A slightly modified form of the invention is illustrated in FIGS. 9, 10, and 11. The reservoir differs from the reservoir illustrated in FIGS. 1 – 8 only in the fact that the sides are generally vertical instead of sloping. The cover is so similar in concept to the cover in FIGS. 1 – 8 that like elements are differentiated only by the addition of a (′) prime mark. The cover material and construction of the canalizing means is identical to the cover previously described and is not repeated. Only the primary elements are identified. The reservoir consists of a bottom 71 and four vertical sides 72, 73, 74 and 75. The cover consists of a flexible sheet 1′ sufficient to substantially cover the sidewalls and bottom of the reservoir when the reservoir is substantially empty. The periphery 11′ of the reservoir is preferably rounded to eliminate sharp corners so that the cover may be placed over the rounded edges and held in place as by a berm of sand or dirt 24′ or other anchorage means. Weights 36′ are connected to the sheet along a line 33′ to form canal 13′ which is generally along the longitudinal axis of the reservoir in a generally vertical plane. Canal 14′ intersects one end of canal 13′ and corner 26′. Canal 15′ intersects one end of canal 13′ and corner 27′. Canal 16′ intersects the other end of canal 13′ and corner 28′ designated by an arrow indicated by the same number. Canal 17′ intersects an end of canal 13′ and corner 29′. Horizontal cover portions 19′, 20′, 21′ and 22′ are formed when the reservoir is filled as shown in FIG. 9 or partially filled as shown in FIG. 10. The bottom of canal 13′ is defined by fold line 33′. The bottom of canal 14′ is defined by generally horizontal line 47′ which intersects fold line 33′ and by sloping line 46′ which intersects corner 26′. It is essential that the weights 36′ be either segmented or flexible. As shown in FIG. 11, when the reservoir is empty, line 46′ is vertical and line 47′ is horizontal. In a similar manner line canal 15′ is defined by bottom fold line 52′ which is horizontal and fold line 53′ which is vertical. Canal 16′ is defined by horizontal line 59′ and vertical line 60′ when the reservoir is empty. Canal 17′ is defined by bottom line consisting of a horizontal line 66′ and vertical line 67′.

Figure 12:
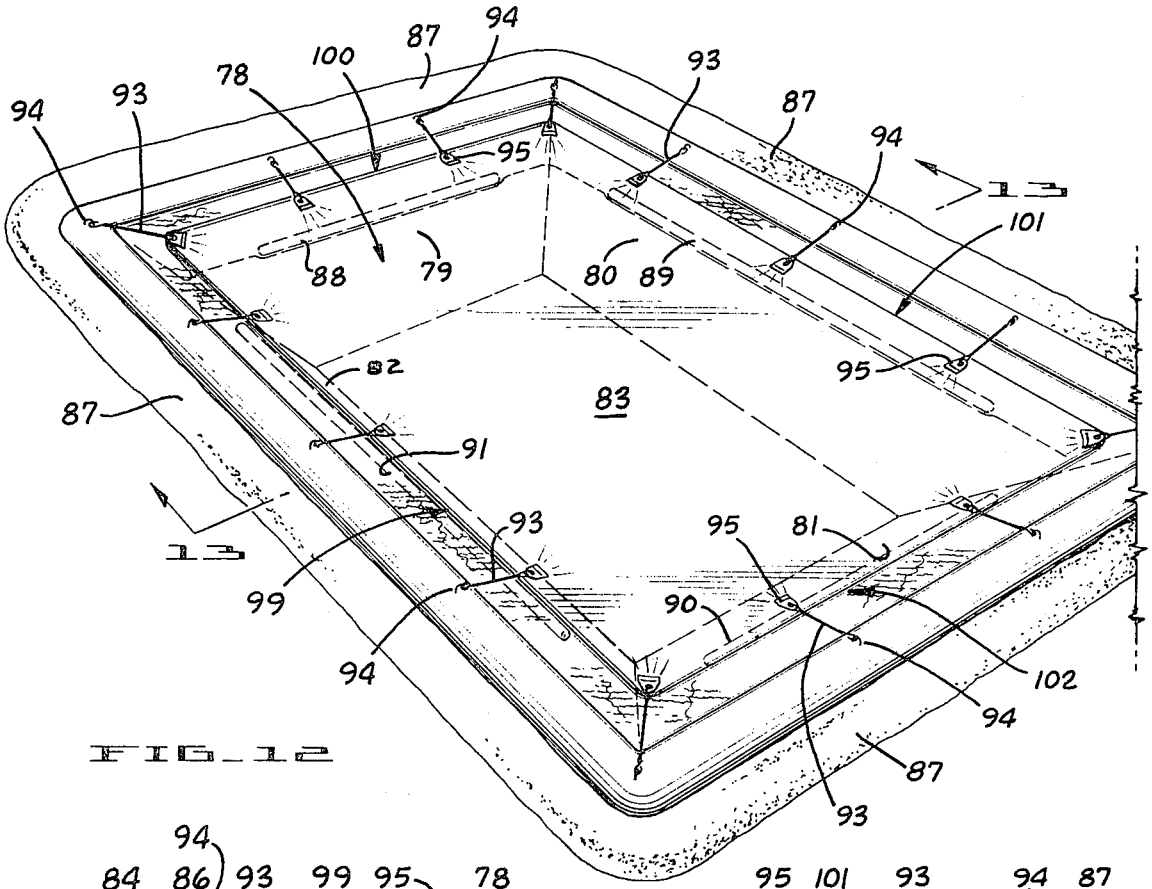
FIG. 12 is a perspective view of a slant wall reservoir as shown in FIGS. 1 – 8 showing another form of the cover of the present invention.
Figure 13:
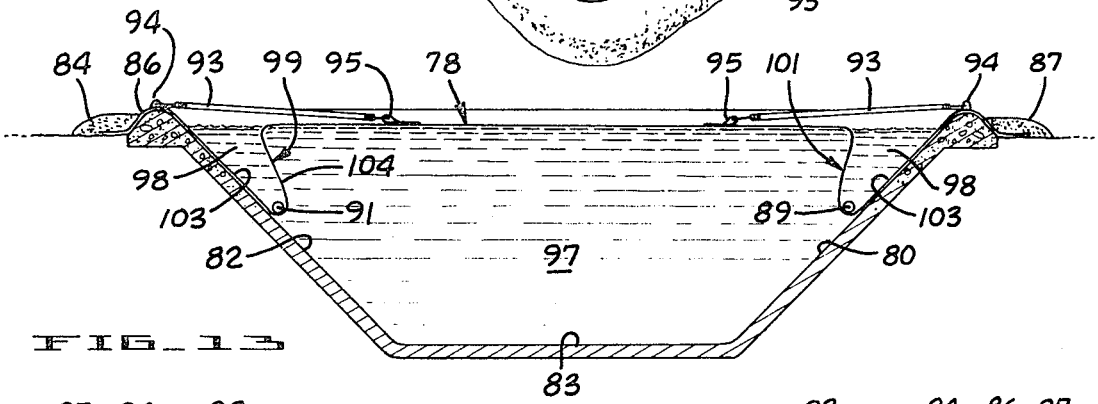
FIG. 13 is a cross sectional view of the reservoir of FIG. 12 taken generally along line 13—13. The reservoir is full and there is considerable surface water.
Figure 14:
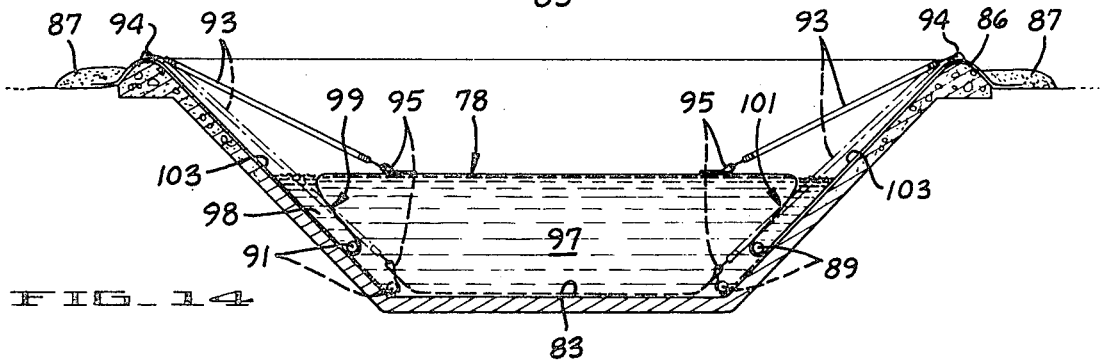
FIG. 14 is a cross sectional view of the reservoir of FIG. 12 taken generally along line 13 — 13. The solid lines indicate the position of the cover of FIG. 12 when the reservoir is about half full. The broken lines indicate the position of the cover of FIGS. 12 and 13 when there is no water in the reservoir.

Another form of the invention is shown in FIGS. 12, 13, and 14. The cover 78 consists of a flexible sheet of fluid impervious material of sufficient area to substantially cover the sloping sidewalls 79, 80, 81, and 82 and generally level bottom 83 of the reservoir when it is substantially empty. The cover is securely connected at its periphery 84 as by lapping the cover over the preferably rounded periphery 86 of the reservoir and attaching the edges as by a layer of sand or soil 87.

The canalizing means consists of elongated generally cylindrical weights 88, 89, 90, and 91 placed on the upperside of the cover for rolling movement up and down the sides of the reservoir. Weights 88 and 90 have a length shorter than the short side of the trapezoidal shaped reservoir ends and weights 89 and 91 have a length shorter than the short side of the reservoir traperzoidal shaped sides. The weights are preferably of the type previously described.

In order to confine the canals to a well defined area of the periphery of the reservoir it is necessary to provide elastic means such as bungee cords 93 or weather resistant rubber straps attached at spaced stations about the periphery of the reservoir at anchors 94 and sheet anchors 95.

When the reservoir is filled with water 97 and surface water 98, fills the canals, the cover takes the form shown in FIGS. 12 and 13. Canals 99, 100, 101 and 102 are formed about the periphery. Each canal such as canal 99 is formed with a portion 103 of the cover held against the sidewall 82 of the reservoir and a portion 104 of the cover is held in a generally upright position by the action of the weight 91. The other three canals are formed in a similar manner.

When the reservoir is partially filled and surface water is present, the configuration of the cover is as shown in solid line in FIG. 14. The weights 88 – 91 will draw the portion 103 of the cover down the side of the reservoir.

When the reservoir is empty, the cover will assume the configuration shown in dotted line in FIG. 14. The weights 88–91 will draw the cover to the bottom of the reservoir.

FIGS. 15 – 21 show another form of the invention. The reservoir 2″ is of identical shape as that described in FIGS. 1 – 7 and the cover 1″ is of the identical type, size and configuration as shown in FIGS. 1 – 7. The canals 13″, 14″, 15″, 16″ and 17″ are formed in the identical manner as those shown in FIGS. 1 – 7. The difference between the cover shown in FIGS. 15 – 21 and FIGS. 1 – 7 is the fact that paired safety floats are attached to the cover on opposite sides of the canals for safety purposes, access and better servicing. The floats may be constructed from polyethylene foam or other semi-rigid material. Workmen will generally be required to inspect the canals or to clean and service the sumps in the canals and the suction hoses therein. Should a tear in the cover occur they can hold onto the floats. A more present danger is the possibility of a person being trapped in the canal if he should slip down below the surface. The pressure of the sides of the canal upon a person might prevent him from floating or swimming to the surface. With paired floats on either side of the canal, a person could save himself by merely extending his arms and grasping the floats if he fell. The floats also add general improved stability to the cover system.

Figure 15:
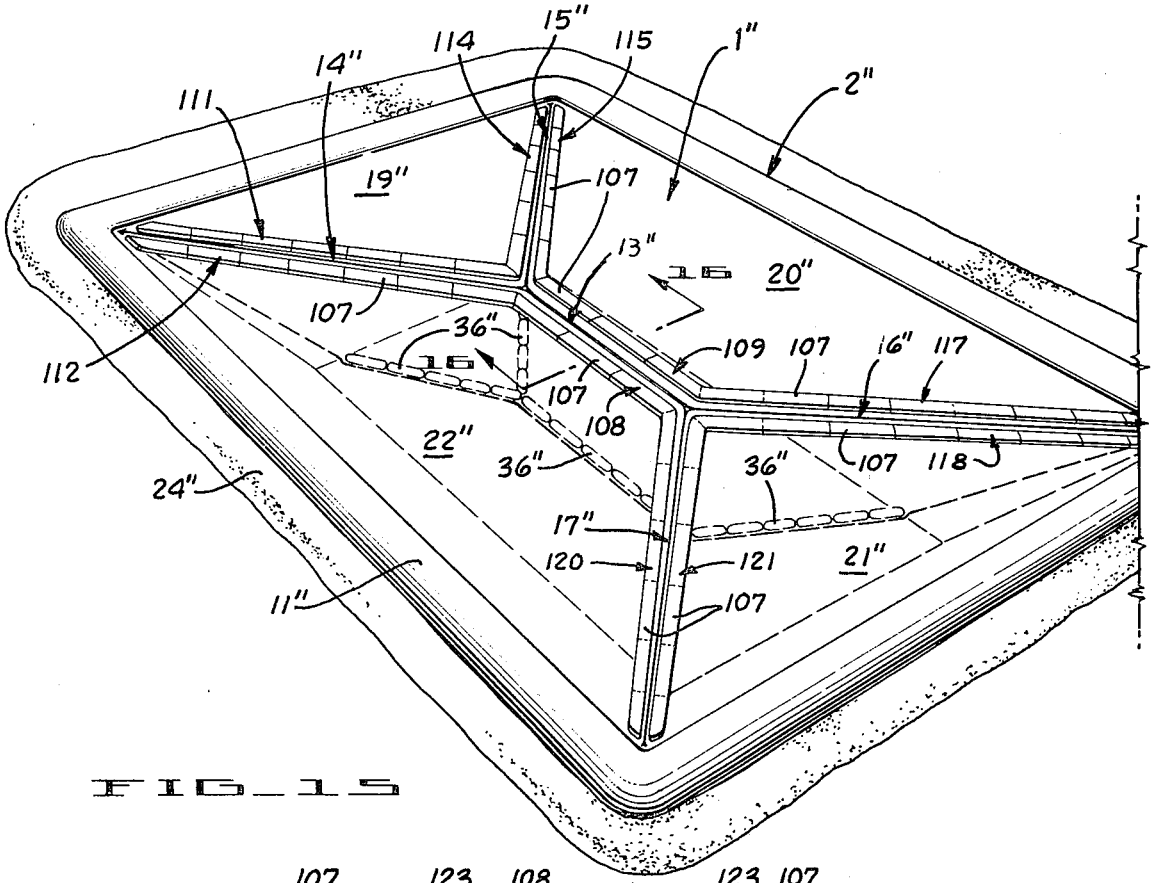
FIG. 15 is a perspective of a slant sided reservoir showing a modified form of the cover shown in FIGS. 1 – 8 with safety floats. The reservoir is shown in the full condition.
Figure 22:
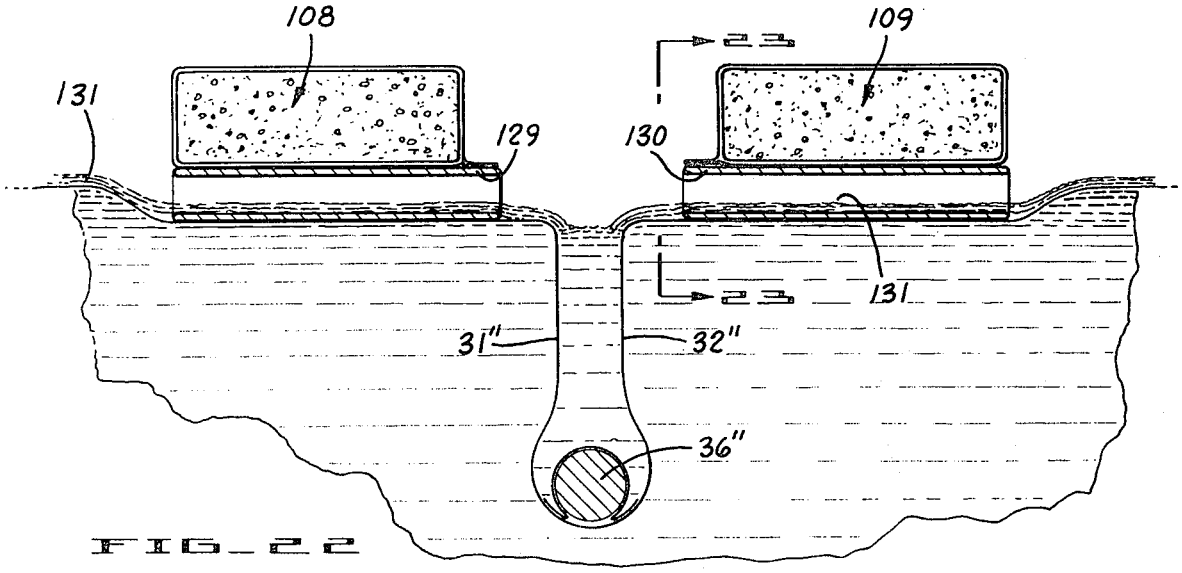
FIG. 22 is a cross sectional view of a portion of a modified form of the cover shown in FIG. 25. The illustration shows one method of draining the surface water on the surface of the cover into the canal sump.

A complete description of the cover in FIG. 15 is not repeated since it is identical to the cover of FIGS. 1 – 7. The main elements only are repeated. The cover is divided into horizontal trapezoidal portions 20″ and 22″ and triangular sections 19″ and 21″. Weights 36″ of the type previously described for FIGS. 1 – 7 form the canals. The floats consist of any semi-rigid buoyant material such as a closed cell plastic foam of polyethylene. As the water level is lowered, the float system can bend due to its semi-rigid nature. Canal 13″ is bordered by elongated paired floats 108 and 109. Canal 14″ is bordered by paired floats 111 and 112. Canal 15″ is bordered by paired floats 114 and 115. Canal 16″ is bordered by paired floats 117 and 118. Canal 17″ is bordered by paired floats 120 and 121. Preferably conduits 129 and 130 as shown in FIG. 22 are inserted beneath the semi-rigid member and the cover to drain off surface water to the canals.

Figure 16:
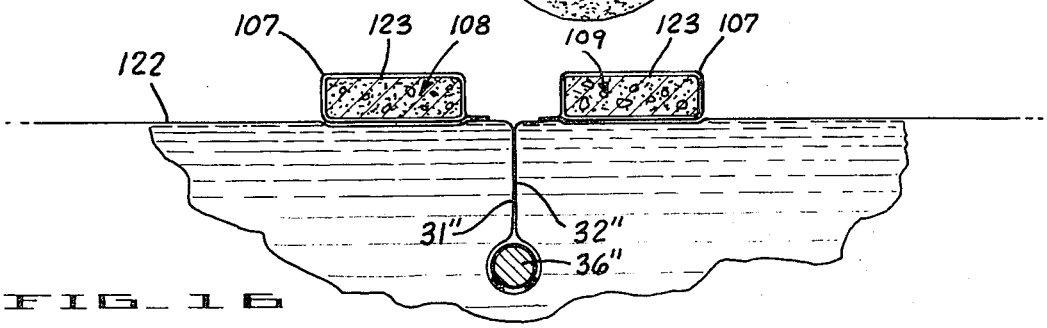
FIG. 16 is a cross section of a portion of the cover taken generally along line 16 — 16 of FIG. 15. No surface water is shown.

FIGS. 15 and 16 show one form of attaching the safety floats 107 to the cover. As shown, the floats 107 are preferably attached to the top surface 122 of the cover. The safety floats 107 except under emergency conditions do not float unless there is surface water on the cover and then they float in the surface water rather than in the water in the reservoir. In this way they act to assist the flow of surface water into the canal. The floats 107 may be attached to the cover by enveloping the floats in the same type of material from which the cover is made and then bonding the enveloping material 123 to the top surface of the cover. FIG. 16 illustrates how closely the sides 31″ and 32″ would be to one another when there was no surface water in the canal.

Figure 17:
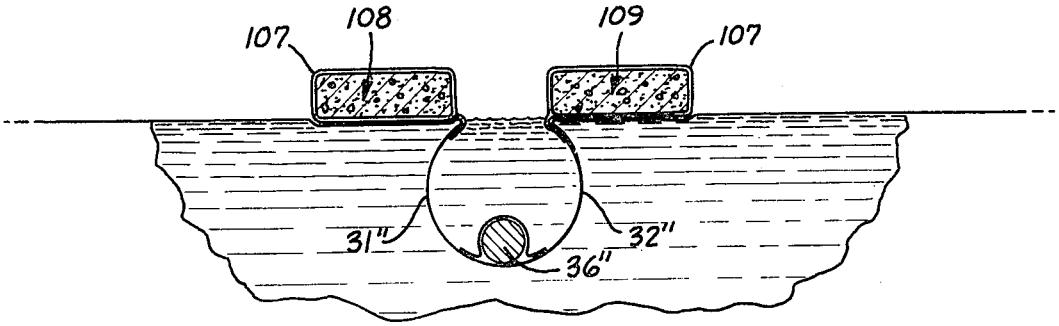
FIG. 17 is a cross section of the reservoir of FIG. 15 taken generally along line 16—16 but with a quantity of surface water.

FIG. 17 illustrates the shapes of a canal when it is filled with surface water. Note that the safety floats are attached to the cover spaced from the weight 36″ so that they are not drawn into the canal at the greatest canal depth which is the condition that obtains when the reservoir is full.

Figure 18:
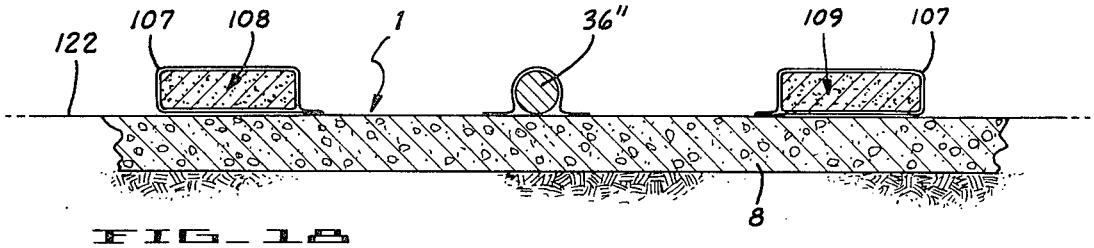
FIG. 18 is a cross section of a portion of the cover shown in FIGS. 15 – 17 taken generally along the line 16 — 16 of FIG. 15. The drawing shows the configuration of the cover when the reservoir is empty.

FIG. 18 illustrates the position of the floats 108 and 109 in relation to weight 36″ when the reservoir is empty and the cover rests on the bottom surface 8 of the reservoir as it would appear during installation.

Figure 23:
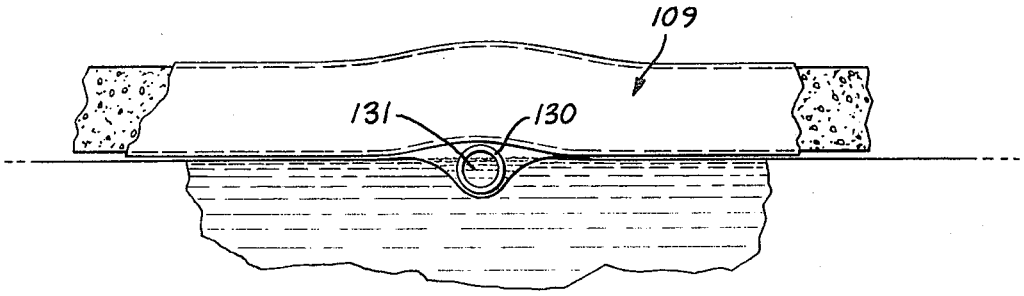
FIG. 23 is a cross sectional view of the invention shown in FIG. 22 taken generally along line 22—22.

The use of paired floats on either side of the canals in effect forms a barrier to the flow of water from the horizontal surface portions of the cover to the canals. One means of delivery water to the canals is to insert conduits 129 and 130 at regular intervals beneath the floats 108 and 109. As seen in FIGS. 22 and 23, surface water 131 flows through the conduit 129 and into a canal formed by separated wall portions 31″ and 32″.

Figure 19:
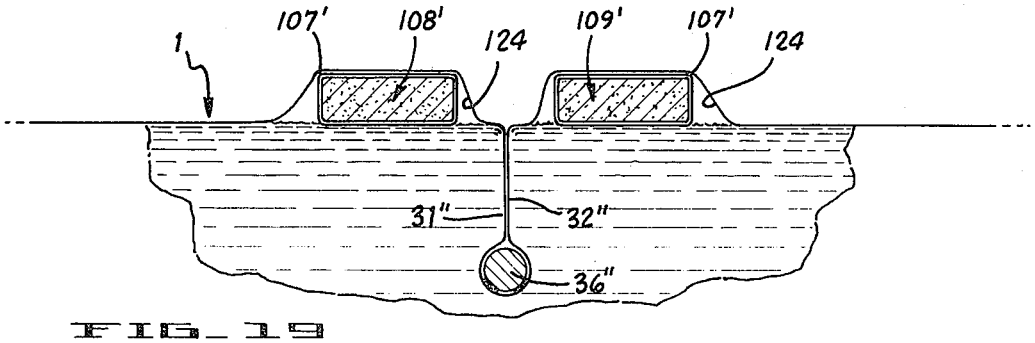
FIG. 19 is a cross sectional view of the cover taken generally along line 16—16 in FIG. 15. The cover is shown in the configuration taken with the reservoir full of water and little or no surface water.

FIG. 19 illustrates a slightly modified method of attaching floats 107′ to the cover 1. Here the floats 108′ and 109′ are attached to the undersurface 124 of the cover 1. The floats, when connected in this manner, are supported on the surface of the reservoir. The canal sides 31'' and 32'' and weights 36'' are identical as previously described.

Figure 20:
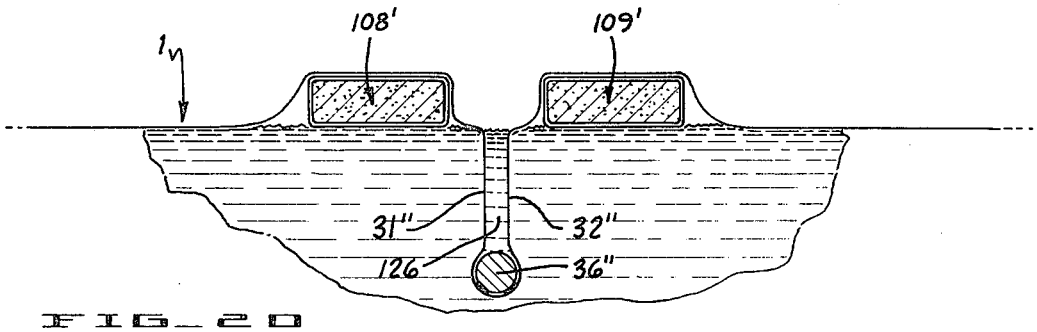
FIG. 20 is a cross sectional view of the cover taken generally along line 16—16 of FIG. 15. The cover is shown in the configuration taken when the reservoir is full and there is a quantity of surface water.

FIG. 20 illustrates the configuration taken by the canal sides 31'' and 32'' when a body of surface water 126 fills the canal.

Figure 21:
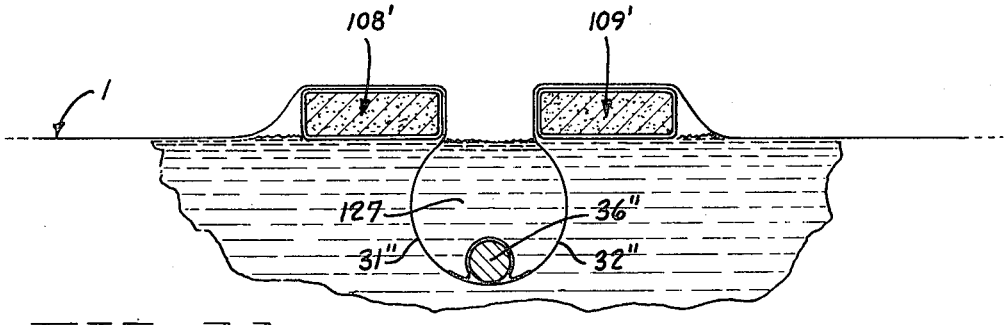
FIG. 21 is a cross sectional view of the cover taken generally along line 16—16 of FIG. 15. The cover is shown in the configuration taken when the reservoir is full and there is a greater amount of surface water than in the illustration shown in FIG. 20.

FIG. 21 is another illustration of the float system of FIG. 20 except that a larger body of surface water 127 fills the canal.

Figure 24:
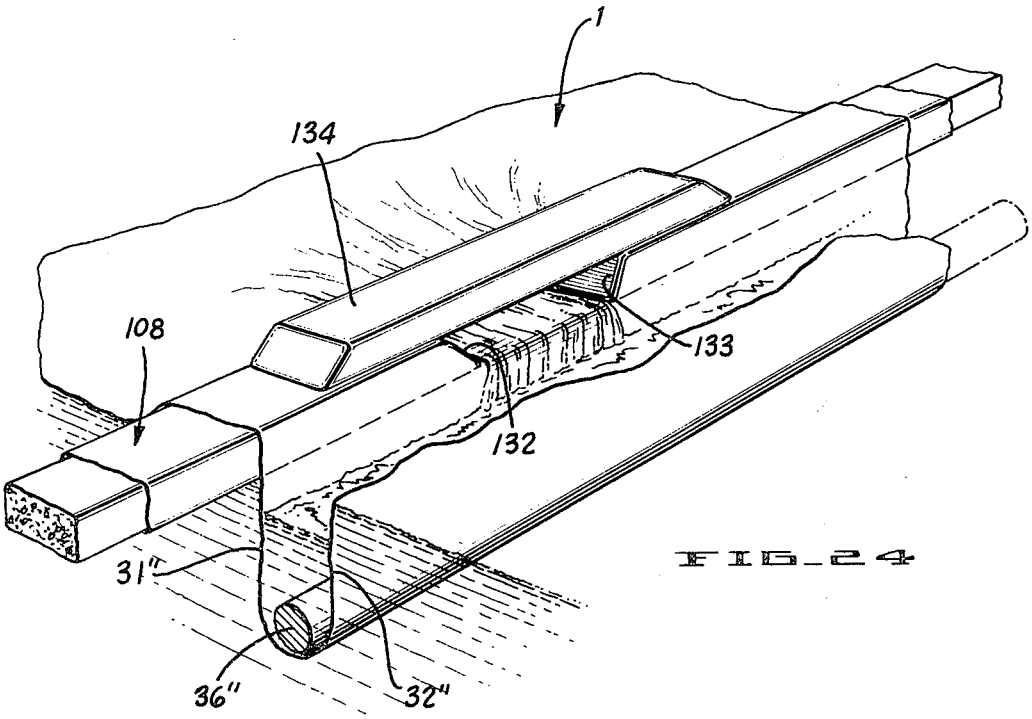
FIG. 24 is a perspective view of another form of the invention shown in FIG. 25 and taken generally in the vicinity of arrow 24. The drawing shows an alternate form of draining surface water on the cover into the canal sump.

FIG. 24 illustrates another means of draining surface water from the cover 1 into the canal formed by portions 31'' and 32'' of the cover. An opening is made in the float 108 defined by wall openings 132 and 133. A strap or bridge member 134 straddles the opening. The strap may be made of any semi-rigid material and preferably is made from the same material as the floats.

Figure 25:
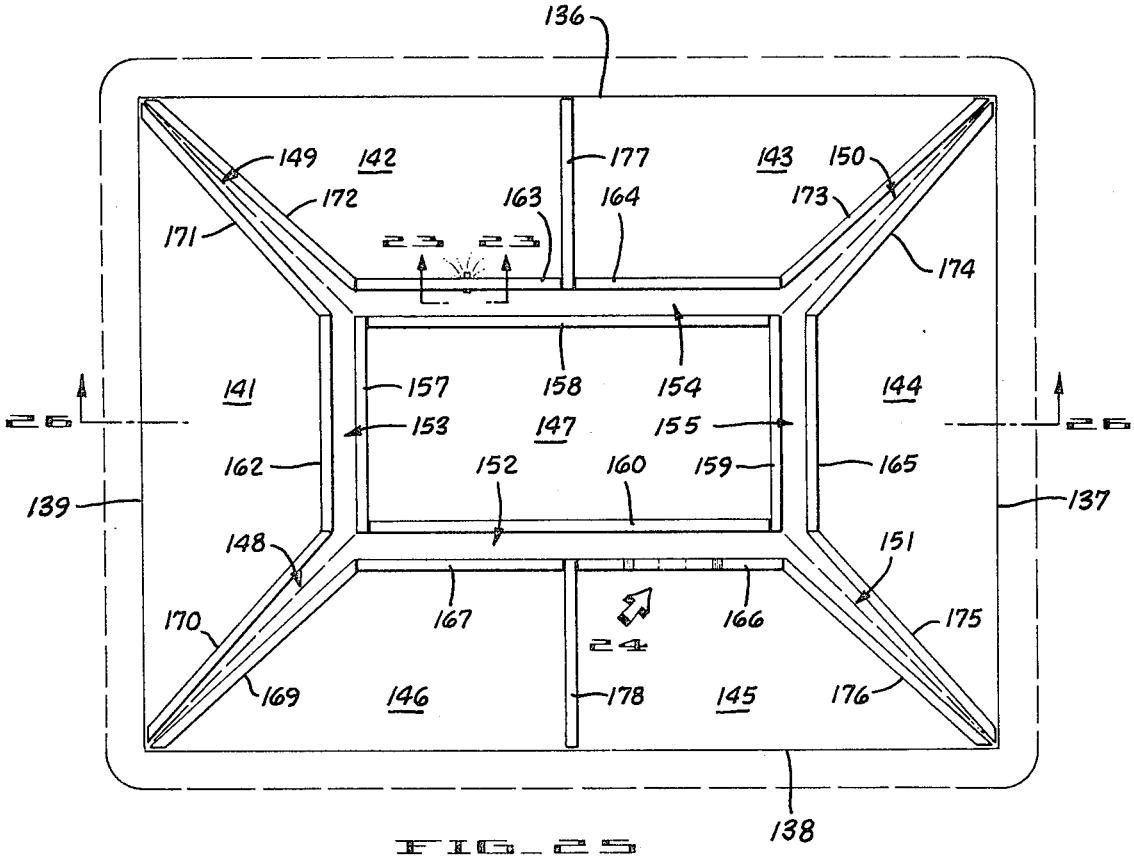
FIG. 25 is a top plan view of still another modified form of the cover of the present invention. In this form of the invention the floats form the canal sumps and the weights are omitted.

FIGS. 25 through 33 illustrate another structure for forming the canals. The reservoir illustrated is the same as is described in FIGS. 1-7 and has straight sides 136, 137, 138 and 139. The material used for the cover is the same as previously described and the size and configuration is selected so that a plurality of horizontal areas 141, 142, 143, 144, 145, and 146 will be formed and a series of interconnected canals 148, 149, 150, 151, 152, 153, 154 and 155 will be created as shown in FIG. 25. No weights are required to form the canals, instead elongated semi-rigid members which need not be buoyant are paired on both sides of the canals. Preferably the paired semi-rigid members consist of elongated slabs of closed cell foam plastic such as polyethylene of sufficient cross section to withstand compression forces experienced in maintaining defined canals. In order to give the semi-rigid members more rigidity, they are enveloped in material such as that used for the cover.

The horizontal area 147 is bounded by semi-rigid members 157, 158, 159 and 160. Open joints between the members permit separation of the members. These members form the inside boundry of canals 152–155. The outside boundries of canals 152–155 are formed by linear semi-rigid paired members 162, 163, 164, 165 and 167. Each of these paired members are separated so that a difference in spacing may occur as the water rises and falls in the reservoir. Canals 148 – 151 which intersect the corners of the reservoir and the inner canals 152 – 155 are bounded by semi-rigid paired members 169, 170, 171, 172, 173, 174, 175, and 176.

In order to maintain the canals in a preselected position, additional elongated semi-rigid members extending from the edge of the reservoir are provided as required. These additional semi-rigid members do not define a canal and serve only to hold the canal members in close relationship to the canal members forming the opposite side of the canal. In FIG. 25 such additional rigid members are shown as buoyant floats 177 and 178. Although not required, weights may be placed in the canal to further define the canals.

Figure 26:
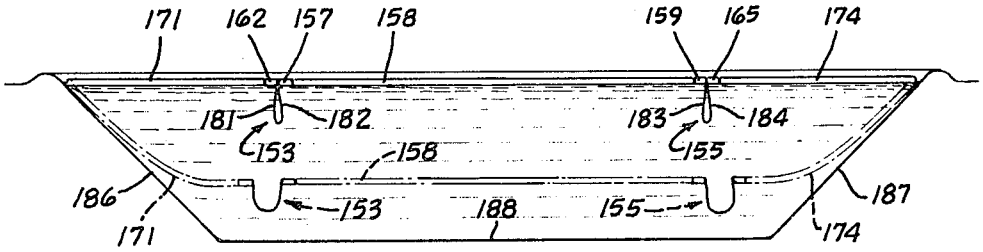
FIG. 26 is a cross section of the reservoir shown in FIG. 25 taken generally along line 26 — 26. The solid lines show the configuration of the cover when the reservoir is full and the broken lines show the configuration of the cover when the reservoir is partially full.

FIG. 26 is a cross section of the reservoir and other liquid shown in FIG. 25 and shows the formation of a typical canal by the semi-rigid members such as canal 153 bounded by members 162 and 157 and canal 155 bounded by members 159 and 165. Canal 153 consists of cover portions 181 and 182. Canal 155 consists of cover portions 183 and 184.

The dotted lines in FIG. 26 indicate the relative positions of the cover and semi-rigid member when a portion of the water in the reservoir is withdrawn. Members 171 and 174 bend as shown to conform to the sloping walls 186 and 187.

Figure 27:
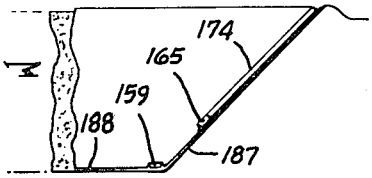
FIG. 27 is a partial view of the cross section shown in FIG. 26 showing the configuration of the cover when the reservoir is empty.
Figure 28:
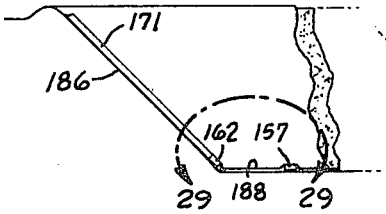
FIG. 28 is a side view of a portion of the cover shown in FIG. 26 but with a modified float system.
Figure 29:
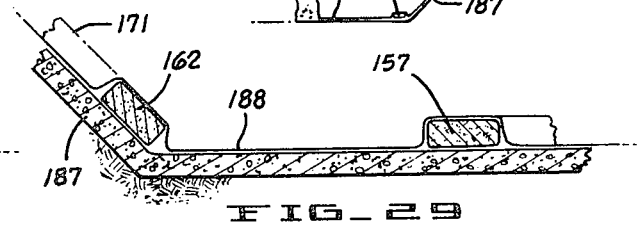
FIG. 29 is an enlarged cross sectional view of the portion of the cover shown in FIG. 28.

FIGS. 27 and 28 illustrate the arrangement of the cover and members when the reservoir is empty. Members 174 and 165 lie against sidewall 187 while member 159 lies on the bottom 188. In FIG. 28, members 162 and 171 lie on the sidewall 186 while member 157 lies on the bottom 188.

Figure 30:
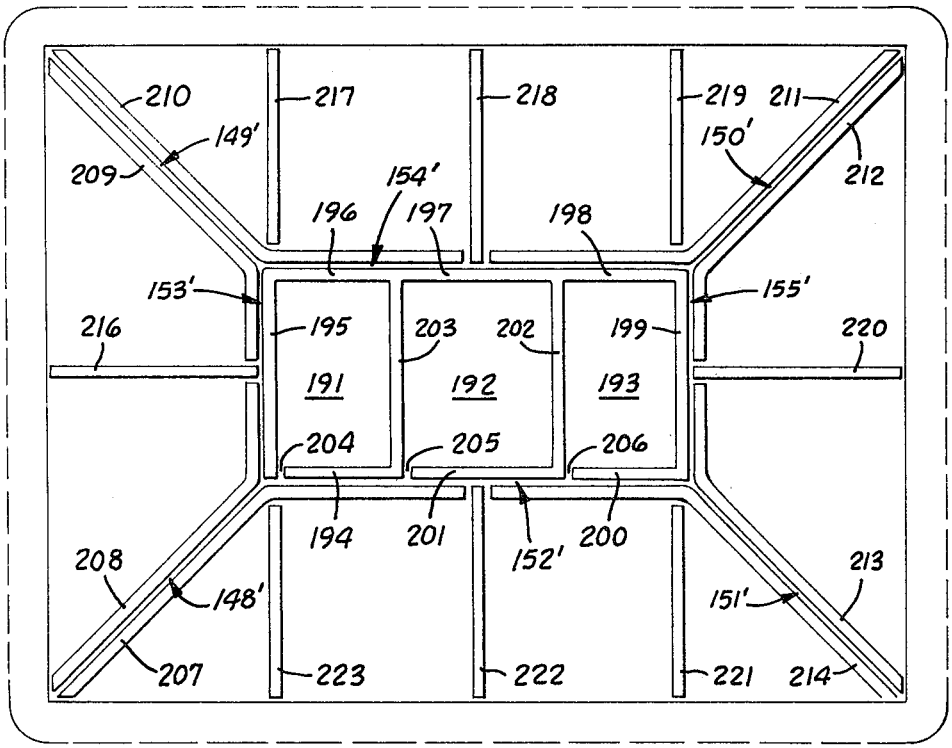
FIG. 30 is a top plan view of an alternate form of the cover of the present invention using a float system similar to that shown in FIGS. 25 – 29 but with a different float system. The reservoir is shown full of water.

The cover shown in FIG. 30 is basically constructed in the same manner as the cover in FIG. 25 but with a different configuration of canalizing semi-rigid paired members. Canals 152', 153', 154' and 155 are formed in a generally rectangular configuration and are intersected by canals 148', 149', 150', and 151' which intersect or closely approach the corners of the reservoir. An integral rectangular horizontal cover portion consisting of panels 191, 192, and 193 is created in the center of the reservoir and is bounded by a system of interconnected elongated semi-rigid members 194, 195, 196, 197, 198, 199, 200, 201, 202, and 203. The foregoing system forms the inside boundry of the canals surrounding the rectangular section. The outside edges of the inner rectangular canals and the canals intersecting the inner canals and the corners of the reservoir consist of elongated semi-rigid members 207, 208, 209, 210, 211, 212, 213, and 214. Additional semi-rigid members 216, 217, 218, 219, 220, 221, 222, and 223 assist in holding the canals in well defined positions. Conduits 129 and 130 between the semi-rigid member and the cover as shown in FIG. 22 drain surface water from the horizontal surface areas into the canals.

Figure 31:
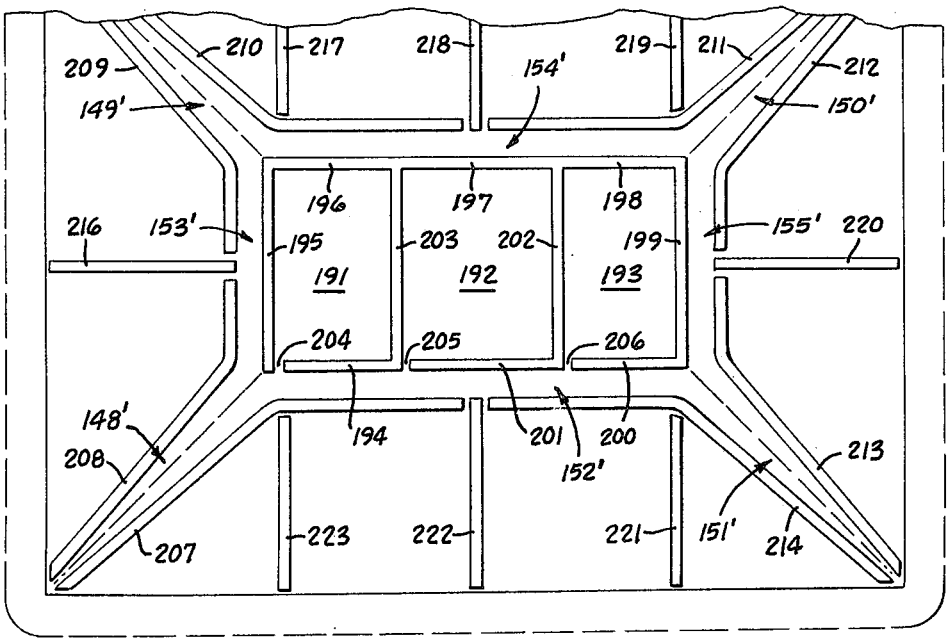
FIG. 31 is a top plan view of the form of the invention shown in FIG. 30 but showing the configuration of the cover when the reservoir is partially empty.

FIG. 31 shows the pattern that the semi-rigid paired members assume when the reservoir is partially empty. All of the canals are broadened by the separation of the paired semi-rigid members.

Figure 32:
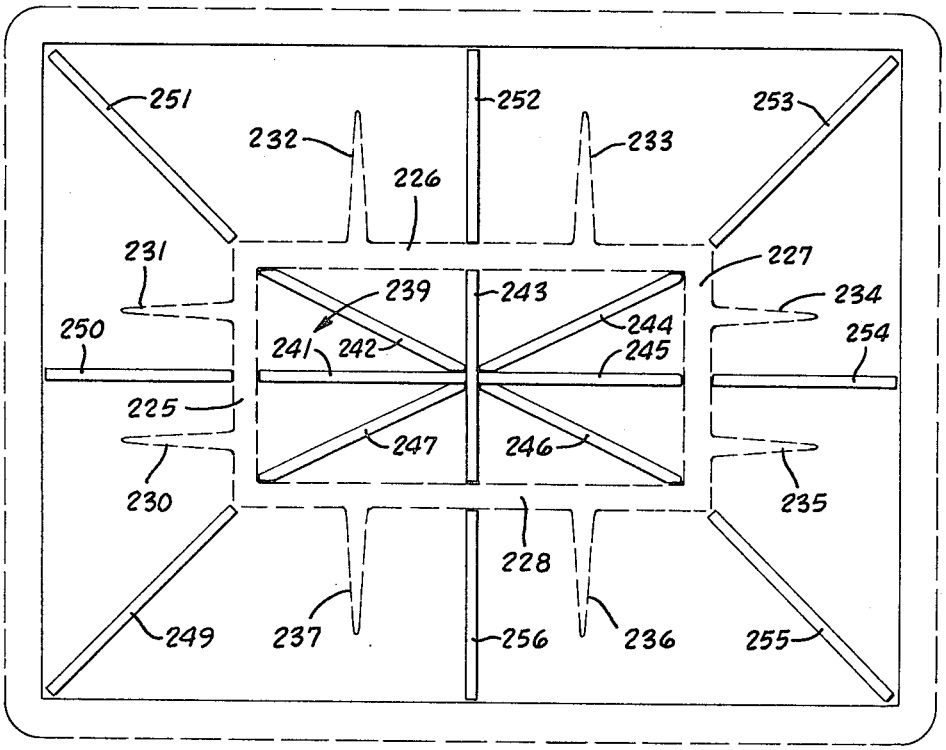
FIG. 32 is a top plan view of still another form of the invention showing the float system as illustrated in FIGS. 24 – 29. The reservoir is shown in the full condition.

FIG. 32 is another modified form of the invention in which the cover material is the same as previously described and the elongated members are constructed in the manner and for similar purposes as the semi-rigid members in FIGS. 25 through 31. The members are arranged and the cover material sized to form a generally rectangular canal system in the center portion of the reservoir consisting of straight canal portions 225, 226, 227 and 228. The canals are shown in broken line. In the configuration shown, short dead end canals 230, 231, 232, 233, 234, 235, 236, and 237 are formed which intersect the main canals of the rectangle. A generally rectangular horizontal area indicated by the number 239 is formed by linear semi-rigid members 241, 242, 243, 244, 246 and 247. Additional members 249, 250, 251, 252, 253, 254, 255, and 256 assist in forming the canal system. All of the semi-rigid canalizing members are preferably formed from buoyant material for safety reasons. Weights, although not required could be used to further define the canals.

Figure 33:
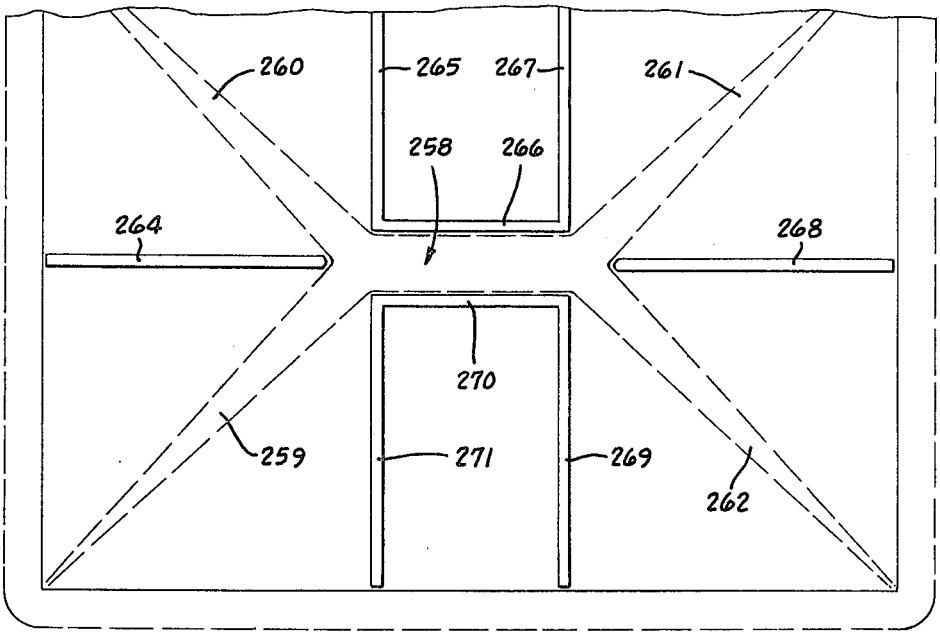
FIG. 33 is a top plan view of still another form of the invention showing the float system as illustrated in FIGS. 25 – 29. The reservoir is shown in the full condition.

The reservoir shown in FIG. 33 is the same configuration as the reservoir shown in FIG. 15. The cover is made from the same material as previously described and the canal system formed is the same configuration as shown in FIG. 15. The type of canalizing member used is the same as previously described in FIG. 32. Unlike the canal system shown in FIG. 15, the canals are formed without the use of weights or paired rigidizing members. The canals formed are shown in broken line and consist of a center canal 258 and canals 259, 260, 261 and 262 which intersect the center canal and the corners. The canalizing system consists of semi-rigid members 264, 265, 266, 267, 268, 269, 270, and 271.

FIGS. 34 – 37 show still another form of the invention.

Figure 34:
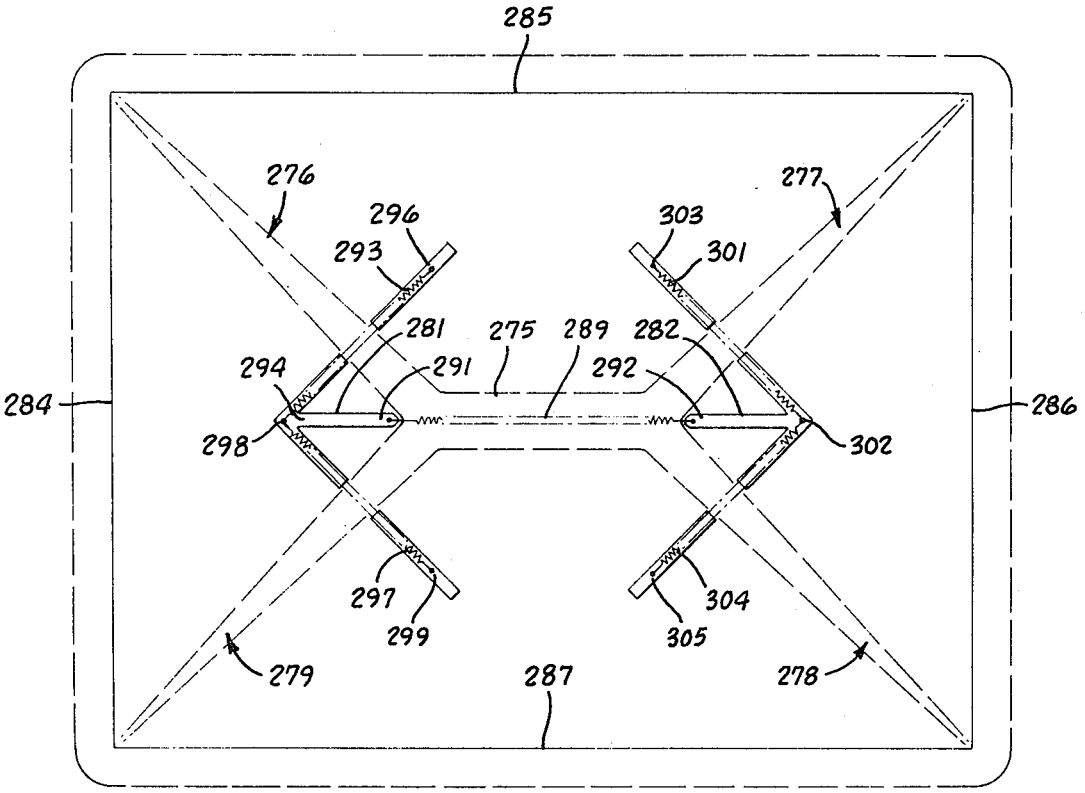
FIG. 34 is a top plan view of still another form of the invention. The reservoir is shown in the partially empty condition.

Referring specifically to FIG. 34, a rectangular reservoir is shown with sloping sides as illustrated in FIG. 1. The cover is made from the same material as previously described. The central canal 275 and the corner intersecting canals 276, 277, 278, and 279 are of the same configuration as illustrated in FIGS. 1, 15 or 33. The canals are formed by first and second elongated semi-rigid members 281 and 282 connected to the cover along one of its axis, spaced from each other and from the sides 284, 285, 286 and 287 of the reservoir. A first biasing means such as a spring 289 or a weather resistant rubber strap is connected to the adjacent ends 291 and 292 of the semi-rigid members urging the semi-rigid members toward one another. A second biasing member such as a spring 293 is connected to the end 294 of the first semi-rigid member adjacent a side of the reservoir and is connected to the cover at a point 296 spaced from the connection and toward an adjacent side 285 of the reservoir at approximately a 45° angle. A third biasing member such as a spring 297 has one end 298 connected to the end 294 of the first elongated semi-rigid member adjacent side 284 of the reservoir and is connected to the cover at a point 299 spaced from the connection 298 and toward an adjacent side 287 of the reservoir at approximately a 90° angle from the second biasing member 293. A fourth biasing member such as spring 301 is connected to the end 302 of the second semi-rigid member 282 adjacent side 286 of the reservoir and is also connected to the cover at a point 303 spaced from the connection 302 and toward an adjacent side 285 of the reservoir at approximately a 45° angle. A fifth biasing member, such as spring 304 has one end connected to the end 302 of the second elongated semi-rigid member 282 adjacent side 286 of the reservoir is positioned toward an adjacent side 287 of the reservoir at approximately a 90° angle from the second biasing member 301 and connected at point 305. The semi-rigid members in combination with the biasing members form canal 275 along the axis of the reservoir between the semi-rigid members 281 and 282 and canals 276 – 279 which intersect the corners of the reservoir and the ends of canal 275.

Figure 35:
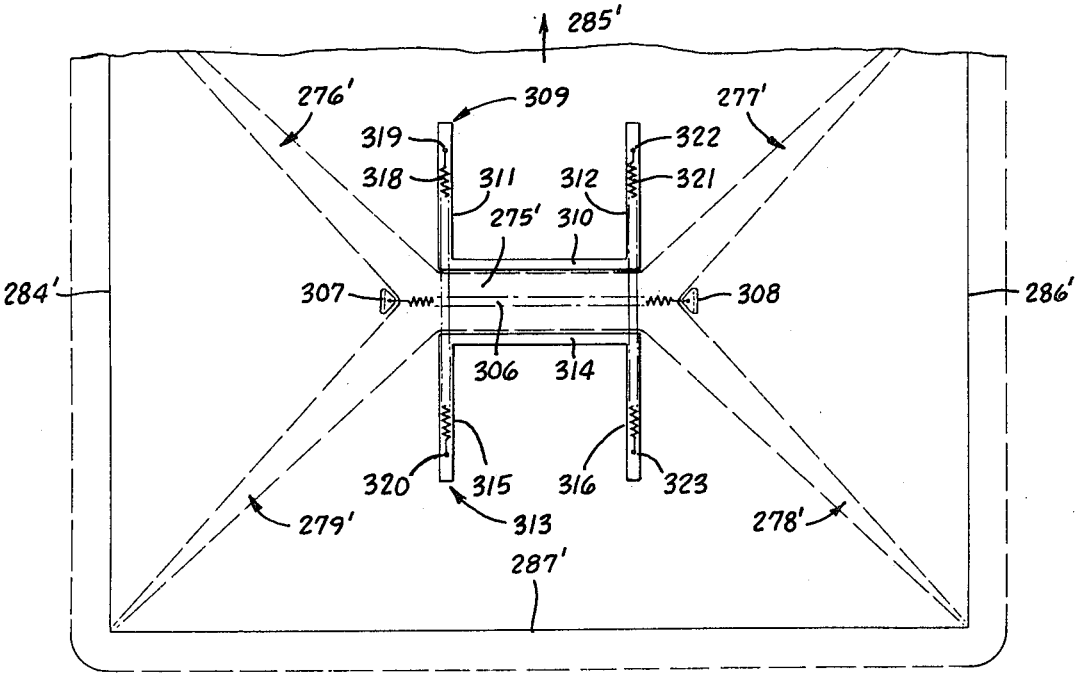
FIG. 35 is a top plan view of still another form of the invention. The reservoir is shown in the partially empty condition.

FIG. 35 illustrates a reservoir cover of the same type and configuration as that shown in FIG. 34. The shape of the center canal 275′ and the corner intersecting canals 276′, 277′, 278′, and 279′ are identical to that shown in FIG. 34. The canals are formed by a first biasing member such as spring 306 connected along an axis of the reservoir at a first point 307 spaced from one of the sides 284′ of the reservoir and connected at a second point 308 spaced from the first point and spaced from an opposite side 286′ of the reservoir and biases the connected points toward one another. A first channel shaped semi-rigid member 309 is attached to the cover and positioned with its base 310 parallel to and spaced from the first biasing member 306. The leg members 311 and 312 extend away from the first biasing member 306. A second channel shaped semi-rigid member 313 is attached to the cover and positioned with its base 314 parallel to and spaced from the base of the first channel member 309 on opposite sides of the first biasing member 306. The leg members 315 and 316 are in alignment with legs 311 and 312 of the first channel member 309. A second biasing member such as spring 318 is attached to the distal ends 319 and 320 of one of the aligned opposed pairs of channel legs 311 and 315 and biases the channel members toward one another. A third biasing member such as spring 321 is attached to the distal ends 322 and 323 of the other of the aligned opposed pairs of channel legs 312 and 316 and biases the channel members toward one another. The semi-rigid channel members and biasing members form the central canal 275′ in alignment with the first biasing member 306 and canals intersecting the central canal and the corners of the reservoir.

Figure 36:
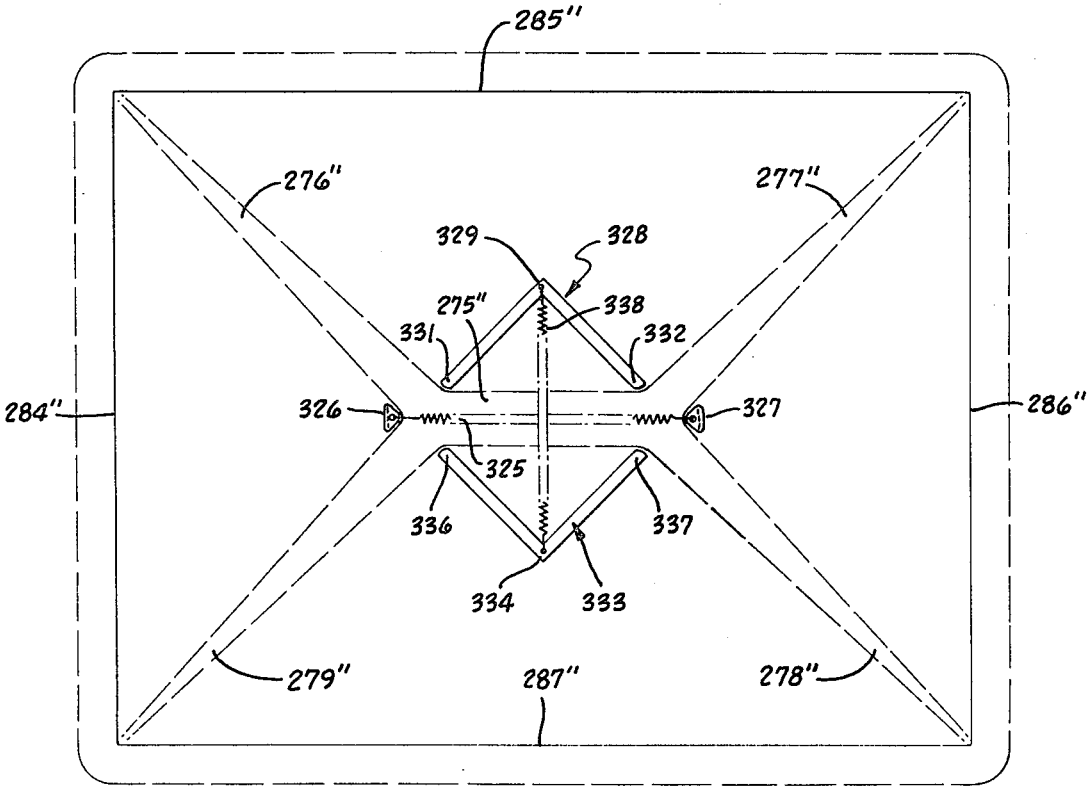
FIG. 36 is a top plan view of another form of the invention. The reservoir is shown in the partially empty condition.

FIG. 36 illustrates a cover for a reservoir having the same shape as the reservoirs shown in FIGS. 34 and 35. The cover shape and size are identical to those in FIGS. 34 and 35 and the configuration of the canals 276″, 277″, 278″ and 279″ are identical. A central canal 275″ connects the corner canals set forth above. The canal forming means consists briefly of a first biasing member 325 connected along an axis of the reservoir at a first point 326 spaced from one side 284″ of the reservoir and is connected at a second point 327 spaced from the first point 326 and spaced from an opposite side 286″ of the reservoir and biases the connected points 326 and 327 toward one another. A first angular semi-rigid member 328 is attached to the cover and is positioned with the apex 329 away from the first biasing member 325 and its first and second ends 331 and 332 are positioned in a direction generally toward the first and second connection points 326 and 327 of the first biasing member 325. A second angular shaped semi-rigid member 333 is attached to the cover and is positioned on opposite sides of the first biasing member 325 with the apex 334 of the angle positioned away from the first biasing member 325 and with its first and second ends 336 and 337 positioned in a direction toward the first and second connection points 326 and 327 of the first biasing member 325. A second biasing member such as spring 338 is connected to the apexes 329 and 334 of the angular members 328 and 333 and biases the angular members toward one another. The angular members 328 and 333 and biasing members 325 and 338 form the central canal 275″ and the intersecting canals 276″ – 279″.

Figure 37:
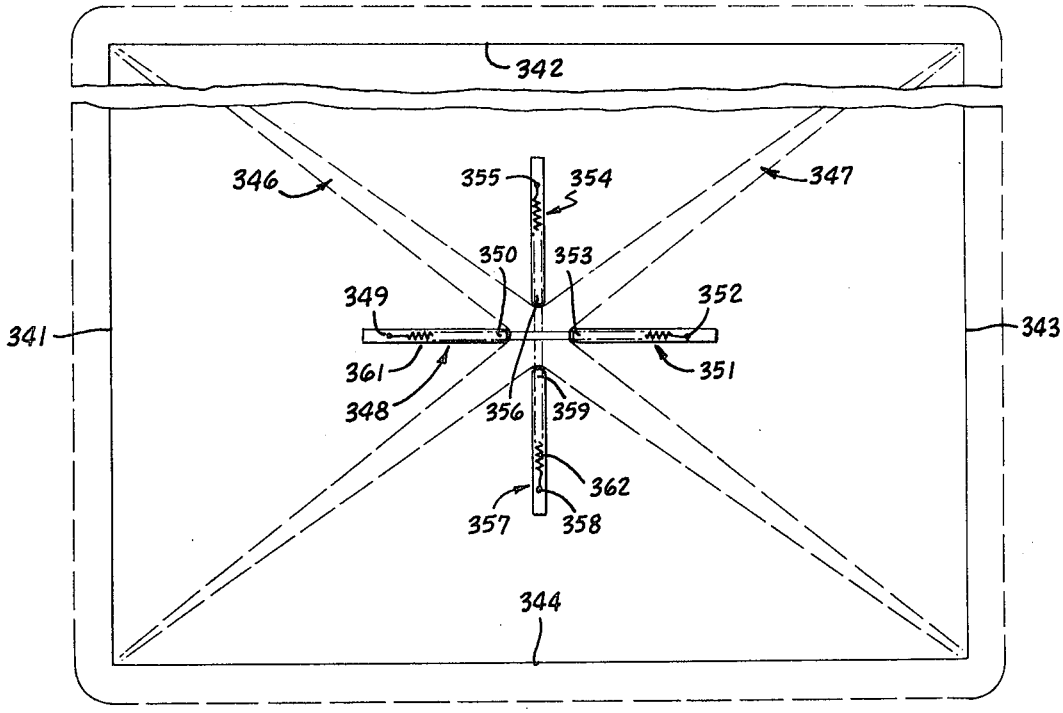
FIG. 37 is a top plan view of another form of the invention. The reservoir is shown in the partially empty condition.

FIG. 37 is another form of reservoir cover in which the cover is made from the same material as all the covers previously described and which is attached to the sides 341, 342, 343 and 344 as previously described. In this form of the invention, intersecting canals 346 and 347 are formed which intersect each other at the approximate center of the reservoir and also intersect the corners of the reservoir. The canals are formed by the following elements. A first elongated semi-rigid member 348 is connected at a first point 349 along a first axis of the reservoir, spaced from a first side 341 and connected at a second point 350 along the axis spaced from the first point and adjacent the center of the reservoir. A second elongated semi-rigid member 351 aligned with the first elongated member is connected at a third point 352 along the axis of the reservoir and is spaced from the second side 343 of the reservoir and is connected at a fourth point 353 spaced from the third point and spaced from the second point adjacent the center of the reservoir. A third elongated semi-rigid member 354 is connected at a fifth point 355 along a second axis which is perpendicular to the first axis and is spaced from a third side 342 of the reservoir and connected at a sixth point 356 along the second axis spaced from the fifth point and adjacent the center of the reservoir. A fourth elongated semi-rigid member 357 is aligned with the third elongated member and is connected at a seventh point 358 along the second axis of the reservoir, spaced from a fourth side 344 of the reservoir and is connected at an eighth point 359 spaced from the seventh point and spaced from the sixth point adjacent the center of the reservoir. A first biasing means such as a spring 361 is connected to the first and third points on the first and second semi-rigid members for biasing the members toward one another. A second biasing member such as a spring 362 is connected to the fifth and seventh points on the third and fourth semi-rigid members for biasing the members toward one another. The cover is formed and the semi-rigid members and biasing members positioned so that the intersecting canals will be formed when the reservoir is full and partially full.

Figure 38:
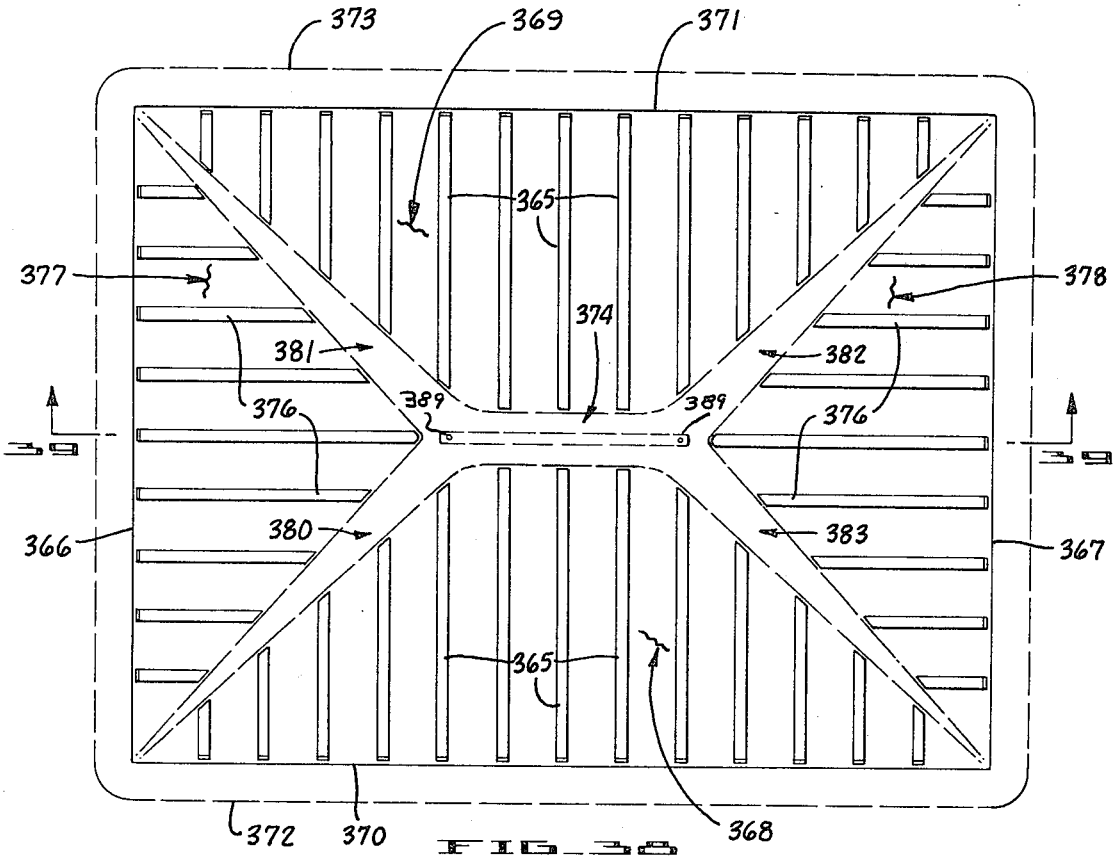
FIG. 38 is a top plan view of another form of the invention. The reservoir is shown in the partially empty condition.

FIG. 38 illustrates a variant form of the invention similar to the form shown in FIG. 33. The cover is made from the same material as previously described and the cover is sized to provide enough material to form folds which create canals at full capacity of the reservoir. The canalizing means consists of a plurality of elongated semi-rigid members 365 as previously described which are attached to the upper side of the cover in spaced parallel relation parallel to the short sides 366 and 367 of the reservoir and form a pair of trapezoids 368 and 369 having approximately equal base angles with their long bases 370 and 371 adjacent the long sides 372 and 373 of the reservoir and spaced from one another at the middle of the reservoir forming a central canal 374. The canalizing means further consists of a plurality of elongated semi-rigid means 376 attached to the cover in spaced parallel relation parallel to the long sides 372 and 373 of the reservoir and form a pair of triangles 377 and 378 with their base lines adjacent the short sides of the reservoir and spaced from the trapezoids forming canals 380, 381, 382 and 383 which intersect the corners of the reservoir and the ends of the central canal. Although, not required, a weight 386 may be attached to the cover to form the canals.

Figure 39:
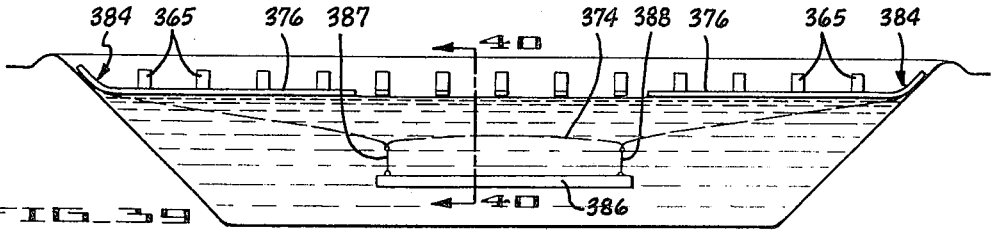
FIG. 39 is a cross section of the reservoir shown in FIG. 38 taken along line 39 – 39.

The semi-rigid members must take considerable compression force and must also bend as shown in FIG. 39 as the water level descends as indicated by arrows 384. The semi-rigid members are preferably made from buoyant material for the safety of personnel working on the cover.

Figure 40:
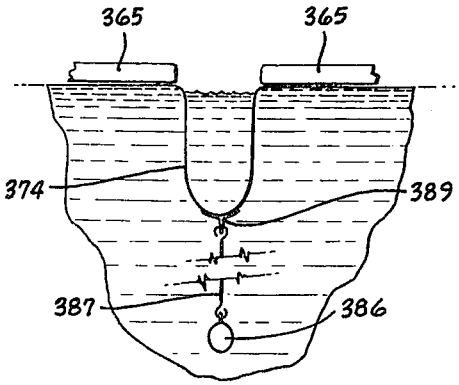
FIG. 40 is a cross sectional view of a portion of the float system taken along line 40 — 40 of FIG. 39. The reservoir is shown in the nearly full condition and with a quantity of surface water.

FIG. 40 shows an alternate method of attaching weights to the cover to form the canals. An elongated rigid weight member 386 is connected to a plurality of elongated flexible members such as cables 387 and 388. The cables are attached to the underside of the cover at canal 374 by appropriate attachment means 389. The purpose of attaching the rigid weight below the cover is to prevent the ends from creating tear stresses in the cover.

Figure 41:
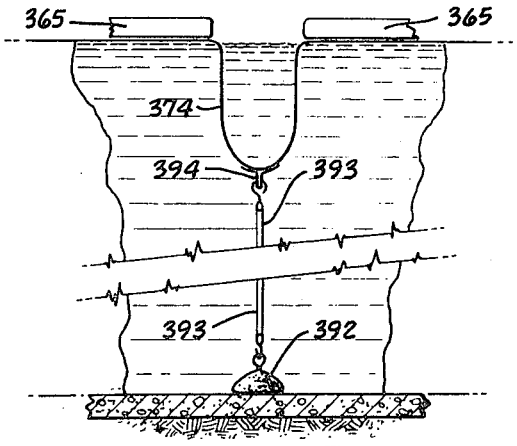
FIG. 41 is a cross sectional view of the invention taken along line 40 — 40 of FIG. 39 but with the reservoir partially filled with water.

FIG. 41 illustrates still another method of canalizing the cover. A plurality of anchor members 392 are connected to the bottom of the reservoir. The anchors may be merely weights which are not normally lifted from the bottom by the cover. Elongated flexible biasing members such as springs or flexible bands 393 are connected to the anchors and to the cover at attachment members 394. The attachment members are connected to the underside of the cover at the canals such as canal 374.

Note that the reservoir float members will create canals in the cover as illustrated in FIG. 38 whether or not a weight member is used.

FIGS. 42 and 43 illustrate the use of the cover of the present invention for circular reservoirs having sloping sides 395. A plurality of closely spaced pairs of semi-rigid members 396 and 397 are attached to the cover 398 and project radially from the perimeter 399 toward the center and end along a concentric circle 400 short of the center and form radial canals 401 intersecting the perimeter 399 of the reservoir. A first plurality of curved semi-rigid members 402 positioned on the concentric circle 400 are connected to the alternate members 396 and 397. A second plurality of semi-rigid curved members 403 are positioned on an inner concentric circle 404 adjacent the first plurality of members forming an annular canal 405 between the members 402 and 403. A plurality of elongated members 406 join the second members 403 for stiffening the inner circle of members. The radial canals 401 intersect the annular canal 405. The floats 396 and 397 are capable of bending to follow the contour of the sloping sides as the water level decreases.

FIGS. 44 and 45 illustrate the fact that the same canalizing system will operate for either a slant sidewall reservoir as shown in FIG. 42 or a circular reservoir having vertical sidewalls 407. FIGS. 44 and 45 show the position of the members 396′, 397′, 402′, 403′ and 404′ when the reservoir is empty. The semi-rigid members are preferably made from buoyant material.

We claim:

1. A cover for an open reservoir subject to fluid level change comprising:

a. a flexible sheet of fluid impervious material of sufficient area to substantially cover the sidewalls and bottom of said reservoir when said reservoir is substantially empty;

b. connection means connecting said cover to the upper periphery of said reservoir;

c. canalizing means creating a plurality of folds in said flexible cover at pre-selected fixed horizontal positions forming defined narrow and generally vertically elongated surface water canals over the entire range of fluid level conditions and forming said sheet in defined generally taut substantially horizontal surface portions supported on the fluid in said reservoir by displacement of fluid;

d. said canals are dimensioned to receive, store and channel surface water separate and apart from the fluid below said cover and in sufficient quantity to prevent substantial build up of surface water on said horizontal surface portions;

e. said canalizing means is constructed to form interconnecting canals which closely approach or intersect the side of said reservoir and maintain said interconnections during normal raising and lowering of the cover surface;

f. said canalizing means includes elongated weights connected to said sheet forming the lowermost portion of said canals;

g. said canal consists of a generally straight line along a substantial mid-portion of said reservoir and four intersecting canals each intersecting a corner of said reservoir and an end of said mid-portion canal.

2. A cover for an open reservoir comprising:

a. a flexible sheet of fluid impervious material of sufficient area to substantially cover the sidewalls and bottom of said reservoir when said reservoir is substantially empty;

b. connection means connecting said cover to the upper periphery of said reservoir;

c. canalizing means creating a plurality of folds in said flexible cover at pre-selected fixed horizontal positions forming defined narrow and generally vertically elongated surface water canals over the entire range of fluid level conditions and forming said sheet in defined generally taut substantially horizontal surface portions supported on the fluid in said reservoir by displacement of fluid;

d. said canals are dimensioned to receive, store and channel surface water separate and apart from the fluid below said cover and in sufficient quantity to prevent substantial build up of surface water on said horizontal surface portions;

e. said canalizing means is constructed to form interconnecting canals which closely approach or intersect the side of said reservoir and maintain said interconnections during normal raising and lowering of the cover surface.

f. said canalizing means consists of elongated generally cylindrical weights placed on the upperside of said cover for rolling movement up and down the sides of said reservoir;

g. elastic means connected at spaced stations about the periphery of said reservoir and to said cover at points spaced from the edge of said reservoir; and h. said cylindrical weights and elastic means cooperating to form a peripheral canal around said reservoir.

3. A cover for an open reservoir comprising:

a. a flexible sheet of fluid impervious material of sufficient area to substantially cover the sidewalls and bottom of said reservoir when said reservoir is substantially empty;

b. connection means connecting said cover to the upper periphery of said reservoir;

c. canalizing means creating a plurality of folds in said flexible cover at pre-selected fixed horizontal positions forming defined narrow and generally vertically elongated surface water canals over the entire range of fluid level conditions and forming said sheet in defined generally taut substantially horizontal surface portions supported on the fluid in said reservoir by displacement of fluid;

d. said canals are dimensioned to receive, store and channel surface water separate and apart from the fluid below said cover and in sufficient quantity to prevent substantial build up of surface water on said horizontal surface portions;

e. said canalizing means is constructed to form interconnecting canals which closely approach or intersect the side of said reservoir and maintain said interconnections during normal raising and lowering of the cover surface;

f. said canalizing means includes elongated weights connected to said sheet forming the lowermost portion of said canals; and g. elongated semi-rigid members substantially continuously attached to said cover on either side of said canals.

4. A cover as described in claim 3 comprising:

a. conduit members spaced between said semi-rigid members and said cover for permitting flow of surface water from said cover to said canals; and b. said semi-rigid members are made of a buoyant material.

5. A cover for an open reservoir comprising:

a. a flexible sheet of fluid impervious material of sufficient area to substantially cover the sidewalls and bottom of said reservoir when said reservoir is substantially empty;

b. connection means connecting said cover to the upper periphery of said reservoir;

c. canalizing means creating a plurality of folds in said flexible cover at pre-selected fixed horizontal positions forming defined narrow and generally vertically elongated surface water canals over the entire range of fluid level conditions and forming said sheet in defined generally taut substantially horizontal surface portions supported on the fluid in said reservoir by displacement of fluid.

d. said canals are dimensioned to receive, store and channel surface water separate and apart from the fluid below said cover and in sufficient quantity to prevent substantial build up of surface water on said horizontal surface portions;

e. said canalizing means is constructed to form interconnecting canals which closely approach or intersect the side of said reservoir and maintain said interconnections during normal raising and lowering of the cover surface.

f. said canalizing means consists of pairs of elongated semi-rigid members attached to said cover and define the edges of said canals; and g. each of the side corners of said reservoir is intersected by a canal.

6. A cover as described in claim 5 comprising:

a. said semi-rigid members are buoyant;

b. additional semi-rigid members extend from the edge of said reservoir to one of said pairs of semi-rigid members defining the edges of said canals;

c. said additional semi-rigid members serve to hold said canal defining members in close relationship to the semi-rigid member defining the opposite side of the canal.

7. A cover for an open reservoir comprising:

a. a flexible sheet of fluid impervious material of sufficient area to substantially cover the sidewalls and bottom of said reservoir when said reservoir is substantially empty;

b. connection means connecting said cover to the upper periphery of said reservoir;

c. canalizing means creating a plurality of folds in said flexible cover at pre-selected fixed horizontal positions forming defined narrow and generally vertically elongated surface water canals over the entire range of fluid level conditions and forming said sheet in defined generally taut substantially horizontal surface portions supported on the fluid in said reservoir by displacement of fluid;

d. said canals are dimensioned to receive, store and channel surface water separate and apart from the fluid below said cover and in sufficient quantity to prevent substantial build up of surface water on said horizontal surface portions;

e. said canalizing means is constructed to form interconnecting canals which closely approach or intersect the side of said reservoir and maintain said interconnections during normal raising and lowering of the cover surface f. said canalizing means include semi-rigid members attached to said cover forming a substantially horizontal rectangular surface portion in the approximate center of said reservoir; and g. auxiliary elongated semi-rigid members are attached to said cover and extend from the periphery of said reservoir to points adjacent and spaced from said rectangular surface portion and form a narrow canal around said rectangular portion.

8. A cover for an open rectangular reservoir comprising:

a. a flexible sheet of fluid impervious material of sufficient area to substantially cover the sidewalls and bottom of said reservoir when said reservoir is substantially empty;

b. connection means connecting said cover to the upper periphery of said reservoir;

c. canalizing means creating a plurality of folds in said flexible cover at pre-selected fixed horizontal positions forming defined narrow and generally vertically elongated surface water canals over the entire range of fluid level conditions and forming said sheet in defined generally taut substantially horizontal surface portions supported on the fluid in said reservoir by displacement of fluid;

d. said canals are dimensioned to receive, store and channel surface water separate and apart from the fluid below said cover and in sufficient quantity to prevent substantial build up of surface water on said horizontal surface portions;

e. said canalizing means is constructed to form interconnecting canals which closely approach or intersect the side of said reservoir and maintain said interconnections during normal raising and lowering of the cover surface;

f. said canalizing means includes a plurality of elongated semi-rigid members attached to said cover forming two substantially horizontal rectangular surface portions extending from opposite sides of said reservoir and forming a narrow canal at approximately the center of said reservoir between said rectangular surface portions; and g. a pair of auxiliary elongated semi-rigid members connected to said cover extending outwardly from the opposite other sides of said reservoir and stopping short of said rectangular portions thereby forming canals extending from the intersection of each of said reservoir corners and connecting with the canal between said rectangular portions.

9. A cover for a rectangular reservoir comprising:

a. a flexible sheet of fluid impervious material of sufficient area to substantially cover the sidewalls and bottom of said reservoir when said reservoir is substantially empty;

b. connection means connecting said cover to the upper periphery of said reservoir;

c. canalizing means creating a plurality of folds in said flexible cover at pre-selected fixed horizontal positions forming defined narrow and generally vertically elongated surface water canals over the entire range of fluid level conditions and forming said sheet in defined generally taut substantially horizontal surface portions supported on the fluid in said reservoir by displacement of fluid;

d. said canals are dimensioned to receive, store and channel surface water separate and apart from the fluid below said cover and in sufficient quantity to prevent substantial build up of surface water on said horizontal surface portions;

e. said canalizing means is constructed to form interconnecting canals which closely approach or intersect the side of said reservoir and maintain said interconnections during normal raising and lowering of the cover surface;

f. first and second elongated semi-rigid members connected to said cover along one of its axis, spaced from each other and from the sides of said reservoir;

g. a first biasing means connected to the adjacent ends of said semi-rigid members urging said semi-rigid members toward one another;

h. a second biasing member connected to the end of said first semi-rigid member adjacent a side of said reservoir and connected to said cover at a point spaced from said connection and toward an adjacent side of said reservoir at approximately a 45° angle;

a third biasing member having one end connected to the end of said first elongated semi-rigid member adjacent a side of said reservoir and connected to said cover at a point spaced from said connection and toward an adjacent side of said reservoir at approximately a 90° angle from said second biasing member;

j. a fourth biasing member connected to the end of said second semi-rigid member adjacent a side of said reservoir and connected to said cover at a point spaced from said connection and toward an adjacent side of said reservoir at approximately a 45° angle;

k. A fifth biasing member having one end connected to the end of said second elongated rigid member adjacent a side of said reservoir is positioned toward an adjacent side of said reservoir at approximately a 90° angle from said fourth biasing member; and l. said semi-rigid members in combination with said biasing members form a canal along the axis of said reservoir between said semi-rigid members and canals intersecting the corners of said reservoir and the ends of said canal along the axis of said reservoir.

10. A cover for a rectangular reservoir comprising:

a. a flexible sheet of fluid impervious material of sufficient area to substantially cover the sidewalls and bottom of said reservoir when said reservoir is substantially empty;

b. connection means connecting said cover to the upper periphery of said reservoir;

c. canalizing means creating a plurality of folds in said flexible cover at pre-selected fixed horizontal positions forming defined narrow and generally vertically elongated surface water canals over the entire range of fluid level conditions and forming said sheet in defined generally taut substantially horizontal surface portions supported on the fluid in said reservoir by displacement of fluid;

d. said canals are dimensioned to receive, store and channel surface water separate and apart from the fluid below said cover and in sufficient quantity to prevent substantial build up of surface water on said horizontal surface portions;

e. said canalizing means is constructed to form interconnecting canals which closely approach or intersect the side of said reservoir and maintain said interconnections during normal raising and lowering of the cover surface;

f. a first biasing member connected along an axis of said reservoir at a first point spaced from one of the sides of said reservoir and connected at a second point spaced from said first point and spaced from an opposite side of said reservoir and biasing said connected points toward one another;

g. a first channel shaped semi-rigid member attached to said cover and positioned with its base parallel to and spaced from said first biasing member; and its leg members extending away from said first biasing member;

h. a second channel shaped semi-rigid member attached to said cover and positioned with its base parallel to and spaced from said base of said first channel member on opposite sides of said first biasing member and its leg members extend away from said first biasing member, each leg being in alignment with a leg of said first channel member;

i. second biasing means attached to the distal ends of one of said aligned opposed pairs of channel legs biasing said channel members toward one another;

j. third biasing means attached to the distal ends of the other of said aligned opposed pairs of channel legs biasing said channel members toward one another; and k. said semi-rigid channel members and said biasing members form a central canal in alignment with said first biasing member and between the bases of said channel members and canals intersecting the corners of said reservoir and the ends of said central canal.

11. A cover for a rectangular reservoir comprising:

a. a flexible sheet of fluid impervious material of sufficient area to substantially cover the sidewalls and bottom of said reservoir when said reservoir is substantially empty;

b. connection means connecting said cover to the upper periphery of said reservoir;

c. canalizing means creating a plurality of folds in said flexible cover at pre-selected fixed horizontal positions forming defined narrow and generally vertically elongated surface water canals over the entire range of fluid level conditions and forming said sheet in defined generally taut substantially horizontal surface portions supported on the fluid in said reservoir by displacement of fluid;

d. said canals are dimensioned to receive, store and channel surface water separate and apart from the fluid below said cover and in sufficient quantity to prevent substantial build up of surface water on said horizontal surface portions;

e. said canalizing means is constructed to form interconnecting canals which closely approach or intersect the side of said reservoir and maintain said interconnections during normal raising and lowering of the cover surface;

f. a first biasing member connected along an axis of said reservoir at a first point spaced from one of the sides of the reservoir and connected at a second point spaced from the first point and spaced from an opposite side of the reservoir and biasing said connected points toward one another;

g. a first angular shaped semi-rigid member attached to said cover and positioned with the apex of the angle away from said first biasing member and its first and second ends positioned in a direction generally toward the first and second connection points of said first biasing member;

h. a second angular shaped semi-rigid member attached to said cover and positioned on opposite sides of said first biasing member with the apex of the angle positioned away from the first biasing member and its first and second ends positioned in a direction toward the first and second connection points of the first biasing member;

i. a second biasing member connected to the apexes of said angular members and biasing said angular members toward one another; and j. said angular members and said biasing members from a central canal in alignment with the first biasing member and between the ends of said angular members and canals intersecting the corners of said reservoir and the ends of said central canal.

12. A cover for a rectangular reservoir comprising:

a. a flexible sheet of fluid impervious material of sufficient area to substantially cover the sidewalls and bottom of said reservoir when said reservoir is substantially empty;

b. connection means connecting said cover to the upper periphery of said reservoir;

c. canalizing means creating a plurality of folds in said flexible cover at pre-selected fixed horizontal positions forming defined narrow and generally vertically elongated surface water canals over the entire range of fluid level conditions and forming said sheet in defined generally taut substantially horizontal surface portions supported on the fluid in said reservoir by displacement of fluid;

d. said canals are dimensioned to receive, store and channel surface water separate and apart from the fluid below said cover and in sufficient quantity to prevent substantial build up of surface water on said horizontal surface portions;

e. said canalizing means is constructed to form interconnecting canals which closely approach or intersect the side of said reservoir and maintain said interconnections during normal raising and lowering of the cover surface;

f. a first elongated semi-rigid member connected at a first point along a first axis of said reservoir spaced from a first side and connected at a second point along said axis spaced from said first point and adjacent the center of said reservoir;

g. a second elongated semi-rigid member aligned with said first elongated member connected at a third point along said axis of said reservoir spaced from a second side of said reservoir and connected at a fourth point spaced from said third point and spaced from said second point adjacent the center of said reservoir;

h. a third elongated semi-rigid member connected at a fifth point along a second axis perpendicular to said first axis spaced from a third side of said reservoir and connected at a sixth point along said second axis spaced from said fifth point and adjacent the center of said reservoir;

i. a fourth elongated semi-rigid member aligned with said third elongated member and connected at a seventh point along said second axis of said reservoir, spaced from a fourth side of said reservoir and connected at an eighth point spaced from said seventh point and spaced from said sixth point adjacent the center of said reservoir;

j. a first biasing means connected to said first and second semi-rigid members for biasing said members toward one another;

k. a second biasing means connected to said third and fourth semi-rigid members for biasing said members toward one another; and l. said semi-rigid members and said biasing members forming intersecting canals which also intersect the corners of said reservoir.

13. A cover for an open reservoir comprising:

a. a flexible sheet of fluid impervious material of sufficient area to substantially cover the sidewalls and bottom of said reservoir when said reservoir is substantially empty;

b. connection means connecting said cover to the upper periphery of said reservoir;

c. canalizing means creating a plurality of folds in said flexible cover at pre-selected fixed horizontal positions forming defined narrow and generally vertically elongated surface water canals over the entire range of fluid level conditions and forming said sheet in defined generally taut substantially horizontal surface portions supported on the fluid in said reservoir by displacement of fluid;

d. said canals are dimensioned to receive, store and channel surface water separate and apart from the fluid below said cover and in sufficient quantity to prevent substantial build up of surface water on said horizontal surface portions;

e. said canalizing means is constructed to form interconnecting canals which closely approach or intersect the side of said reservoir and maintain said interconnections during normal raising and lowering of the cover surface;

f. said canalizing means consists of a plurality of elongated semi-rigid members attached to said cover in spaced parallel relation, parallel to the short side of said reservoir and forming a pair of trapezoids having approximately equal base angles with their long bases adjacent the long sides of said reservoir and spaced from one another at the middle of said reservoir forming a central canal; and g. said canalizing means further consists of a plurality of elongated semi-rigid members attached to said cover in spaced parallel relation parallel to the long sides of said reservoir and forming a pair of triangles with their base line adjacent the short sides of said reservoir and spaced from said trapezoids forming canals intersecting the corners of said reservoir and said central canal.

14. A cover for a reservoir comprising:

a. a flexible sheet of fluid impervious material of sufficient area to substantially cover the sidewalls and bottom of said reservoir when said reservoir is substantially empty;

b. connection means connecting said cover to the upper periphery of said reservoir;

c. canalizing means creating a plurality of folds in said flexible cover at pre-selected fixed horizontal positions forming defined narrow and generally vertically elongated surface water canals over the entire range of fluid level conditions and forming said sheet in defined generally taut substantially horizontal surface portions supported on the fluid in said reservoir by displacement of fluid;

d. said canals are dimensioned to receive, store and channel surface water separate and apart from the fluid below said cover and in sufficient quantity to prevent substantial build up of surface water on said horizontal surface portions;

e. said canalizing means is constructed to form interconnecting canals which closely approach or intersect the side of said reservoir and maintain said interconnections during normal raising and lowering of the cover surface;

f. an elongated weight member;

g. elongated flexible members connected to said weight member for carrying said weight at a selected distance below said canals; and h. attachment means connecting said elongated flexible members at a plurality of points to the lowermost portion of said canals.

15. A cover for a reservoir comprising:

a. a flexible sheet of fluid impervious material of sufficient area to substantially cover the sidewalls and bottom of said reservoir when said reservoir is substantially empty;

b. connection means connecting said cover to the upper periphery of said reservoir;

c. canalizing means creating a plurality of folds in said flexible cover at pre-selected fixed horizontal positions forming defined narrow and generally vertically elongated surface water canals over the entire range of fluid level conditions and forming said sheet in defined generally taut substantially horizontal surface portions supported on the fluid in said reservoir by displacement of fluid;

d. said canals are dimensioned to receive, store and channel surface water separate and apart from the fluid below said cover and in sufficient quantity to prevent substantial build up of surface water on said horizontal surface portions;

e. said canalizing means is constructed to form interconnecting canals which closely approach or intersect the side of said reservoir and maintain said interconnections during normal raising and lowering of the cover surface;

f. a plurality of anchor members connected to the bottom of said reservoir;

g. elongated flexible biasing members connected to said anchors; and h. attachment means connecting said biasing members to a plurality of points on the lowermost portion of said canals.

16. A cover for an open reservoir comprising:

a. a flexible sheet of fluid impervious material of sufficient area to substantially cover the sidewalls and bottom of said reservoir when said reservoir is substantially empty;

b. connection means connecting said cover to the upper periphery of said reservoir;

c. canalizing means creating a plurality of folds in said flexible cover at pre-selected fixed horizontal positions forming defined narrow and generally vertically elongated surface water canals over the entire range of fluid level conditions and forming said sheet in defined generally taut substantially horizontal surface portions supported on the fluid in said reservoir by displacement of fluid;

d. said canals are dimensioned to receive, store and channel surface water separate and apart from the fluid below said cover and in sufficient quantity to prevent substantial build up of surface water on said horizontal surface portions;

e. said canalizing means is constructed to form interconnecting canals which closely approach or intersect the side of said reservoir and maintain said interconnections during normal raising and lowering of the cover surface;

f. said reservoir is of circular configuration;

g. a plurality of closely spaced pairs of semi-rigid members attached to said cover projecting radially from the perimeter toward the center and ending along a concentric circle short of the center; and forming radial canals intersecting the perimeter of said reservoir;

h. a first plurality of semi-rigid curved members positioned on said concentric circle and connected to alternate pairs of said semi-rigid members;

i. a second plurality of semi-rigid curved members positioned on an inner concentric circle adjacent said first plurality of curved semi-rigid members forming an annular canal therebetween;

j. a plurality of elongated semi-rigid members joining said second curved semi-rigid members for stiffening said inner concentric circle of semi-rigid members; and k. said radial canals intersect said annular canal.

* * * * *